US012637188B2

(12) United States Patent
Ikegaya

(10) Patent No.: US 12,637,188 B2
(45) Date of Patent: May 26, 2026

(54) WATERCRAFT PROPULSION SYSTEM, AND WATERCRAFT

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 432 days.

(21) Appl. No.: 18/381,209

(22) Filed: Oct. 18, 2023

(65) Prior Publication Data

US 2024/0132189 A1 Apr. 25, 2024
US 2024/0227998 A9 Jul. 11, 2024

(30) Foreign Application Priority Data

Oct. 19, 2022 (JP) ..... 2022-167327

(51) Int. Cl.
*B63H 5/125* (2006.01)
*B63H 20/00* (2006.01)
*B63H 25/42* (2006.01)

(52) U.S. Cl.
CPC ..... *B63H 5/125* (2013.01); *B63H 2020/003* (2013.01); *B63H 2025/425* (2013.01)

(58) Field of Classification Search
CPC B63H 20/007; B63H 21/20; B63H 2021/202; B63H 2021/205; B63H 2020/003; B63H 5/125; B63H 20/08; B63H 20/10; B63H 2020/103; B63H 20/106
See application file for complete search history.

(56) References Cited

U.S. PATENT DOCUMENTS

| | | | | |
|---|---|---|---|---|
| 7,381,108 | B1 | 6/2008 | Salmon | |
| 11,352,114 | B2 | 6/2022 | Osara et al. | |
| 2008/0233812 | A1 | 9/2008 | Kawanishi et al. | |
| 2022/0017200 | A1 | 1/2022 | Nanjo | |
| 2023/0087634 | A1* | 3/2023 | Kimpara | B63H 20/06 440/3 |

OTHER PUBLICATIONS

Official Communication issued in corresponding European Patent Application No. 23202933.0, mailed on Apr. 9, 2024.

* cited by examiner

*Primary Examiner* — Andrew Polay
(74) *Attorney, Agent, or Firm* — Keating & Bennett, LLP

(57) ABSTRACT

A watercraft propulsion system includes a main propulsion device attachable to a hull, an auxiliary propulsion device attachable to the hull and having a lower rated output than the main propulsion device, a lift to move up and down a propeller of the auxiliary propulsion device between an underwater position and an above-water position, and a controller. The controller includes a plurality of control modes including a combined use mode in which a propulsive force generated by the main propulsion device and a propulsive force generated by the auxiliary propulsion device are used in combination. The controller is configured or programmed to restrict the main propulsion device and the auxiliary propulsion device from being driven according to the combined use mode when the propeller of the auxiliary propulsion device is in the above-water position.

10 Claims, 14 Drawing Sheets

WATERCRAFT PROPULSION SYSTEM, AND WATERCRAFT

CROSS REFERENCE TO RELATED APPLICATIONS

This application claims the benefit of priority to Japanese Patent Application No. 2022-167327 filed on Oct. 19, 2022. The entire contents of this application are hereby incorporated herein by reference.

BACKGROUND OF THE INVENTION

1. Field of the Invention

The present invention relates to a watercraft propulsion system, and a watercraft including the watercraft propulsion system.

2. Description of the Related Art

US 2008/0233812 A1 discloses the setting of a tilt angle limit value for the tilt-up of an outboard motor including an engine (engine outboard motor) above water. The tilt angle limit value is set with the use of a service tool connected to the control device of the outboard motor. US 2008/0233812 A1 describes a case in which an outboard motor tilt-up operation is performed with the engine operating during shift-in when the tilt angle limit value is set. In this case, if the tilt angle is increased to a predetermined level, the engine is stopped.

US 2022/0017200 A1 discloses an electric outboard motor including an electric motor as its power source. The electric outboard motor includes a tilt mechanism, and is configured so that its outboard motor body can be held at a higher position away from the water surface when the outboard motor is not used.

SUMMARY OF THE INVENTION

The inventor of preferred embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

A watercraft propulsion system sometimes includes a plurality of propulsion devices provided on the hull of a watercraft. By way of example, the watercraft propulsion system may include a main propulsion device having a higher output and an auxiliary propulsion device having a lower output. For example, the main propulsion device is an engine propulsion device, and the auxiliary propulsion device is an electric propulsion device. When the watercraft sails toward a destination at a higher speed, the main propulsion device is typically used. At this time, the propeller of the auxiliary propulsion device is preferably located above the water surface so as not to provide sailing resistance. After the watercraft reaches around the destination, the auxiliary propulsion device is used for fine adjustment of the position and the azimuth of the hull. In this case, the hull is moved at a lower speed, so that the main propulsion device provides no substantial sailing resistance.

The inventor of preferred embodiments of the present invention conducted studies on how to control the behavior of the hull by using the main propulsion device and the auxiliary propulsion device in combination and in association with each other. With the use of the plurality of propulsion devices, hull behaviors that are not possible with the use of a single propulsion device can be achieved. For example, a hull translation behavior can be achieved without bow turning. Further, where the main propulsion device and the auxiliary propulsion device are used in combination and assigned with different functions, some hull behaviors can be more advantageously achieved than where the main propulsion device or the auxiliary propulsion device is used alone. Specific examples of such a hull behavior include hull holding behaviors which are each controlled to maintain the position and/or the azimuth of the hull.

Of course, the control of the hull behavior with the combined use of the main propulsion device and the auxiliary propulsion device can be achieved by effective propulsive forces generated by the main propulsion device and the auxiliary propulsion device. However, as described above, the propeller of the auxiliary propulsion device is preferably kept retracted above the water surface until the watercraft reaches near the destination. After the watercraft reaches near the destination, therefore, the operator of the system lowers the propeller of the auxiliary propulsion device into the water to use the auxiliary propulsion device. If the operator commands to perform a watercraft maneuvering control with the combined use of the main propulsion device and the auxiliary propulsion device without performing the propeller lowering operation, the auxiliary propulsion device fails to apply the effective propulsive force to the hull and, thus, is uselessly driven. In addition, if only the main propulsion device applies the propulsive force to the hull, the hull behavior cannot be achieved as intended, so that the main propulsion device is also uselessly driven.

In view of the foregoing, preferred embodiments of the present invention provide watercraft propulsion systems that are each able to reduce the useless driving of the propulsion devices, and watercraft including the watercraft propulsion systems.

In order to overcome the previously unrecognized and unsolved challenges described above, a preferred embodiment of the present invention provides a watercraft propulsion system including a main propulsion device attachable to a hull, an auxiliary propulsion device attachable to the hull and having a lower rated output than the main propulsion device, a lift to move up and down the propeller of the auxiliary propulsion device between an underwater position and an above-water position, and a controller. The controller includes a plurality of control modes including a combined use mode in which a propulsive force generated by the main propulsion device and a propulsive force generated by the auxiliary propulsion device are used in combination, and is configured or programmed to restrict the main propulsion device and the auxiliary propulsion device from being driven according to the combined use mode when the propeller of the auxiliary propulsion device is in the above-water position.

With this arrangement, when the propeller of the auxiliary propulsion device is in the above-water position, the main propulsion device and the auxiliary propulsion device are restricted from being driven according to the combined use mode. This makes it possible to reduce or eliminate the useless driving of the auxiliary propulsion device in a state such that the propulsive force cannot be effectively applied to the hull. Further, even if the main propulsion device is driven alone, a hull behavior intended by the combined use mode cannot be achieved and, therefore, the driving of the main propulsion device is also restricted. Thus, the useless driving of the main propulsion device can also be reduced.

For the restriction of driving the propulsion devices, the driving of the propulsion devices may be prohibited, or the maximum outputs (maximum propulsive forces) of the propulsion devices may be limited.

In a preferred embodiment of the present invention, the controller is configured or programmed to determine whether or not the propeller of the auxiliary propulsion device is in the above-water position in the combined use mode, and to restrict the main propulsion device and the auxiliary propulsion device from being driven if the propeller of the auxiliary propulsion device is in the above-water position.

With this arrangement, it is determined whether or not the propeller of the auxiliary propulsion device is in the above-water position in the combined use mode, and the driving of the main propulsion device and the auxiliary propulsion device is properly restricted. This makes it possible to reduce or eliminate the useless driving of the main propulsion device and the auxiliary propulsion device.

In a preferred embodiment of the present invention, the controller is configured or programmed to determine whether or not the propeller of the auxiliary propulsion device is in the above-water position, and to restrict the control mode from being switched to the combined use mode if the propeller of the auxiliary propulsion device is in the above-water position.

With this arrangement, it is determined whether or not the propeller of the auxiliary propulsion device is in the above-water position, and the switching to the combined use mode is restricted (specifically, prohibited). Therefore, the main propulsion device and the auxiliary propulsion device can be properly prohibited from being driven according to the combined use mode. This makes it possible to reduce or eliminate the useless driving of the main propulsion device and the auxiliary propulsion device.

In a preferred embodiment of the present invention, the watercraft propulsion system further includes a command input operable by an operator to command to switch a control mode to the combined use mode. The controller is configured or programmed to actuate the lift to locate the propeller of the auxiliary propulsion device in the underwater position if the combined use mode is commanded by the command input.

With this arrangement, if the combined use mode is commanded, the propeller of the auxiliary propulsion device is automatically located in the underwater position. Thus, the operator can command the combined use mode without considering the position of the propeller of the auxiliary propulsion device, and the driving of the main propulsion device and the auxiliary propulsion device can be properly restricted. That is, if the propeller of the auxiliary propulsion device is located in the underwater position, the driving of the main propulsion device and the auxiliary propulsion device according to the combined use mode is no longer restricted, so that the hull behavior is achieved as intended by the operator. This makes it possible to smoothly perform the watercraft maneuvering operation in the combined use mode while reducing the useless driving of the main propulsion device and the auxiliary propulsion device.

In a preferred embodiment of the present invention, the combined use mode includes a holding mode in which at least one of the position and the azimuth of the hull is maintained.

With this arrangement, the position and/or the azimuth of the hull is maintained in the holding mode by using the main propulsion device and the auxiliary propulsion device in combination. If the propeller of the auxiliary propulsion device is located in the underwater position, the driving of the main propulsion device and the auxiliary propulsion device according to the holding mode is permitted. This makes it possible to maintain the position and/or the azimuth of the hull while reducing the useless driving of the main propulsion device and the auxiliary propulsion device.

In a preferred embodiment of the present invention, the main propulsion device is an engine propulsion device including an engine as its power source, and the auxiliary propulsion device is an electric propulsion device including an electric motor as its power source.

For example, the engine propulsion device as the main propulsion device is used when the watercraft is sailing to a destination at a higher speed. During the higher-speed sailing, the propeller of the electric propulsion device as the auxiliary propulsion device is located in the above-water position and, therefore, does not provide sailing resistance. When the watercraft reaches near the destination, the combined use mode is often used, in which a propulsive force generated by the engine propulsion device and a propulsive force generated by the electric propulsion device are used in combination. In this case, however, if the propeller of the electric propulsion device is still located in the above-water position, the engine propulsion device and the electric propulsion device are restricted from being driven according to the combined use mode. This makes it possible to reduce the useless driving of the engine propulsion device and the electric propulsion device.

In a preferred embodiment of the present invention, the main propulsion device and the auxiliary propulsion device are attached to the stern of the hull. Alternatively, the watercraft propulsion system may be configured so that the main propulsion device is attached to the stern of the hull, and the auxiliary propulsion device is attached to the bow of the hull.

Another preferred embodiment of the present invention provides a watercraft propulsion system including a main propulsion device attachable to a hull, an auxiliary propulsion device attachable to the hull and having a lower rated output than the main propulsion device, a lift to move up and down the propeller of the auxiliary propulsion device between an underwater position and an above-water position, and a controller configured or programmed to restrict the auxiliary propulsion device from being driven when the propeller of the auxiliary propulsion device is in the above-water position.

With this arrangement, when the propeller of the auxiliary propulsion device is in the above-water position, the driving of the auxiliary propulsion device is restricted. This makes it possible to reduce or eliminate the useless driving of the auxiliary propulsion device.

Another further preferred embodiment of the present invention provides a watercraft propulsion system including an electric propulsion device attachable to a hull, a lift to move up and down the propeller of the electric propulsion device between an underwater position and an above-water position; and a controller. The controller includes a plurality of control modes including a holding mode in which at least one of the position and the azimuth of the hull is maintained, and is configured or programmed to restrict the electric propulsion device from being driven according to the holding mode when the propeller of the electric propulsion device is in the above-water position.

With this arrangement, when the propeller of the electric propulsion device is in the above-water position, the electric propulsion device is restricted from being driven according to the holding mode in which the position and/or the azimuth of the hull is maintained. When the propulsive force of the electric propulsion device does not effectively act on the hull, therefore, the watercraft maneuvering operation is restricted from being performed according to the holding mode in which the propulsive force of the electric propulsion device is used. This makes it possible to reduce or eliminate the useless driving of the electric propulsion device.

Still another preferred embodiment of the present invention provides a watercraft propulsion system including a propulsion device attachable to a hull, a lift to move up and down the propeller of the propulsion device between an underwater position and an above-water position, a controller including a plurality of control modes including a holding mode in which at least one of the position and the azimuth of the hull is maintained, and a command input operable by an operator to command to switch a control mode to the holding mode. The controller is configured or programmed to actuate the lift to locate the propeller of the propulsion device in the underwater position if the holding mode is commanded by the command input, and to keep restricting or prohibiting the propulsion device from being driven until the propeller of the propulsion device is located in the underwater position.

With this arrangement, when the holding mode is commanded, the controller actuates the lift in order to locate the propeller of the propulsion device in the underwater position. Then, the restriction on driving of the propulsion device is maintained until the propulsive force generated by the propulsion device effectively acts on the hull with the propeller located in the underwater position. This makes it possible to smoothly perform the watercraft maneuvering operation in the holding mode while reducing the useless driving of the propulsion device.

Another further preferred embodiment of the present invention provides a watercraft including a hull, and a watercraft propulsion system provided on the hull and having any of the above-described features.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
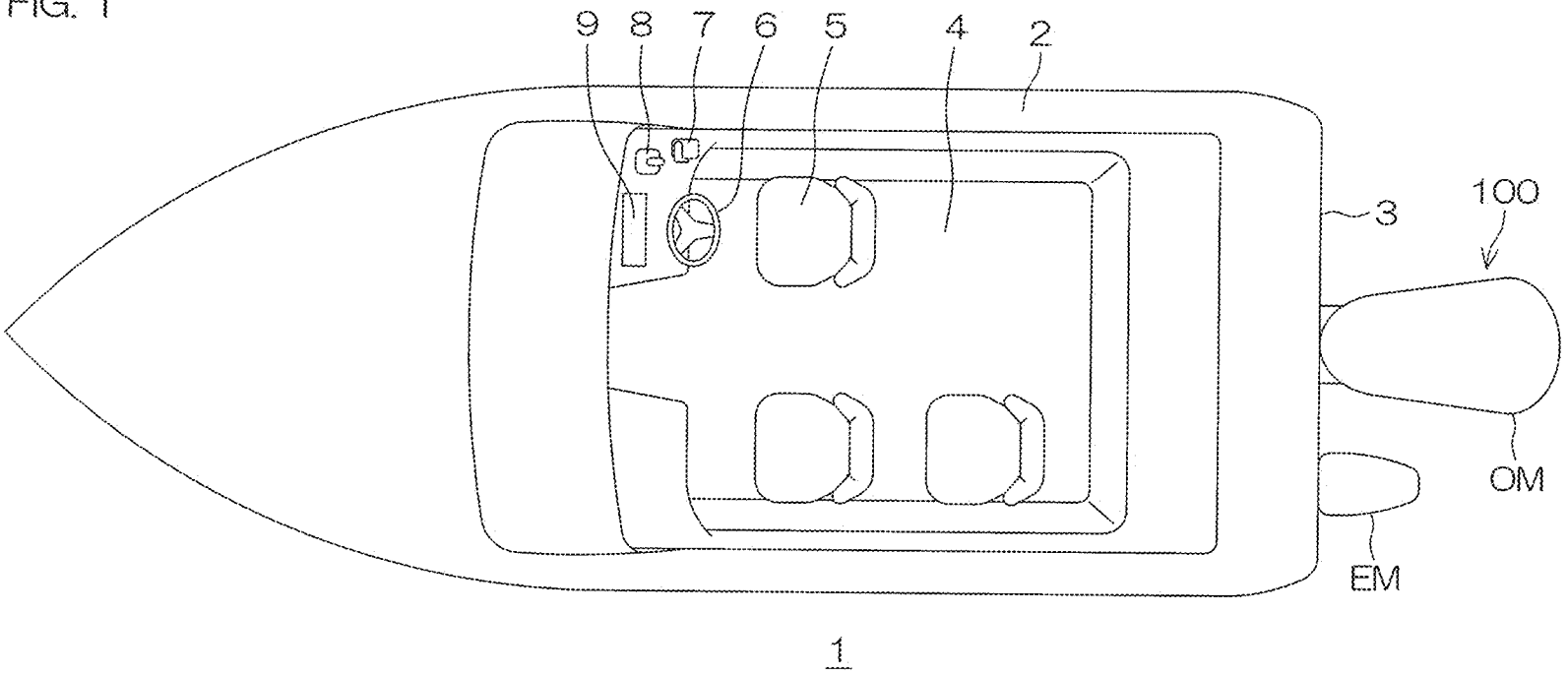
FIG. 1 is a plan view showing an exemplary construction of a watercraft mounted with a watercraft propulsion system according to a preferred embodiment of the present invention.
Figure 2:
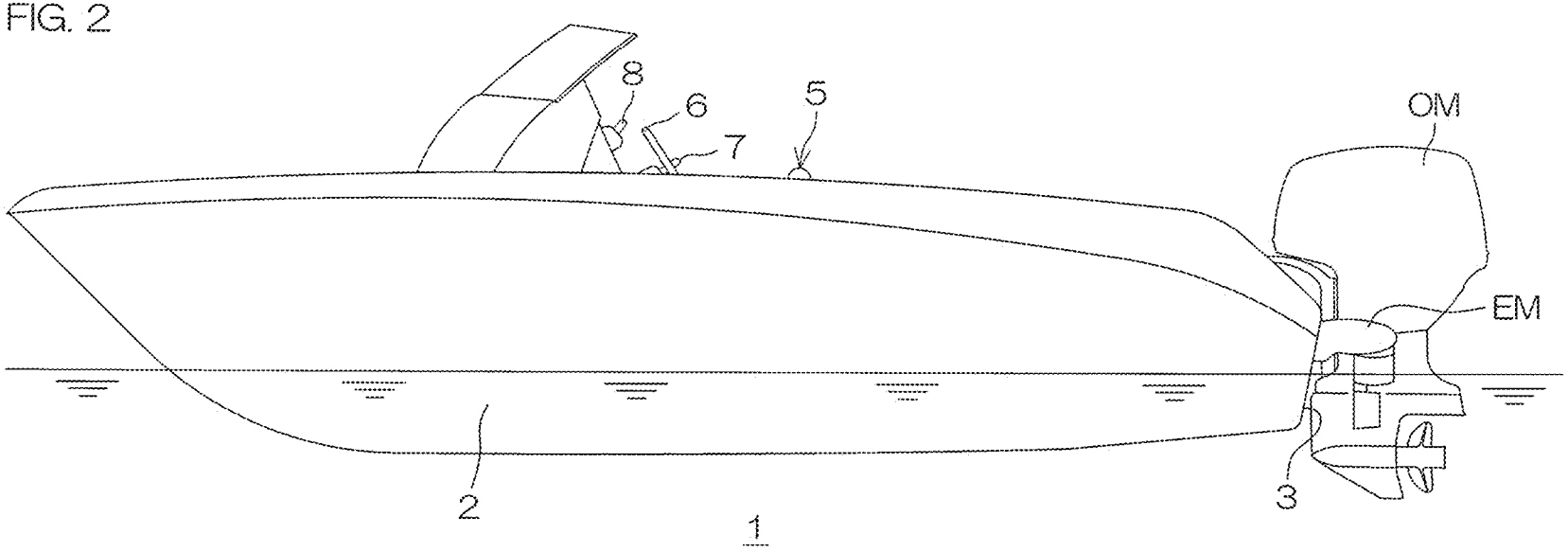
FIG. 2 is a side view of the watercraft as seen from a left side with respect to the bow direction of the watercraft.

FIG. 1 is a plan view showing an exemplary construction of a watercraft 1 mounted with a watercraft propulsion system 100 according to a preferred embodiment of the present invention. FIG. 2 is a side view of the watercraft 1 as seen from a left side with respect to the bow direction of the watercraft 1.

The watercraft 1 includes a hull 2, an engine outboard motor OM attached to the hull 2, and an electric outboard motor EM attached to the hull 2. The engine outboard motor OM and the electric outboard motor EM are examples of the propulsion device. The engine outboard motor OM is an example of the main propulsion device. The electric outboard motor EM is an example of the auxiliary propulsion device having a lower rated output than the main propulsion device. The engine outboard motor OM is an example of the engine propulsion device including an engine as its power source. The electric outboard motor EM is an example of the electric propulsion device including an electric motor as its power source.

In the present preferred embodiment, the engine outboard motor OM and the electric outboard motor EM are attached to the stern 3 of the watercraft 1. More specifically, the engine outboard motor OM and the electric outboard motor EM are disposed side by side transversely of the hull 2 on the stern 3. In this example, the engine outboard motor OM is disposed on a transversely middle portion of the stern 3, and the electric outboard motor EM is disposed outward (leftward) of the transversely middle portion of the stern 3.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operation element operable by an operator to change the course of the watercraft 1. The remote control lever 7 is an operation element operable by the operator to change the magnitude (output) and the direction (forward or reverse direction) of the propulsive force of the engine outboard motor OM, and corresponds to an acceleration operation element. The joystick 8 is an operation element to be operated instead of the steering wheel 6 and the remote control lever 7 by the operator to maneuver the watercraft.

Figure 3:
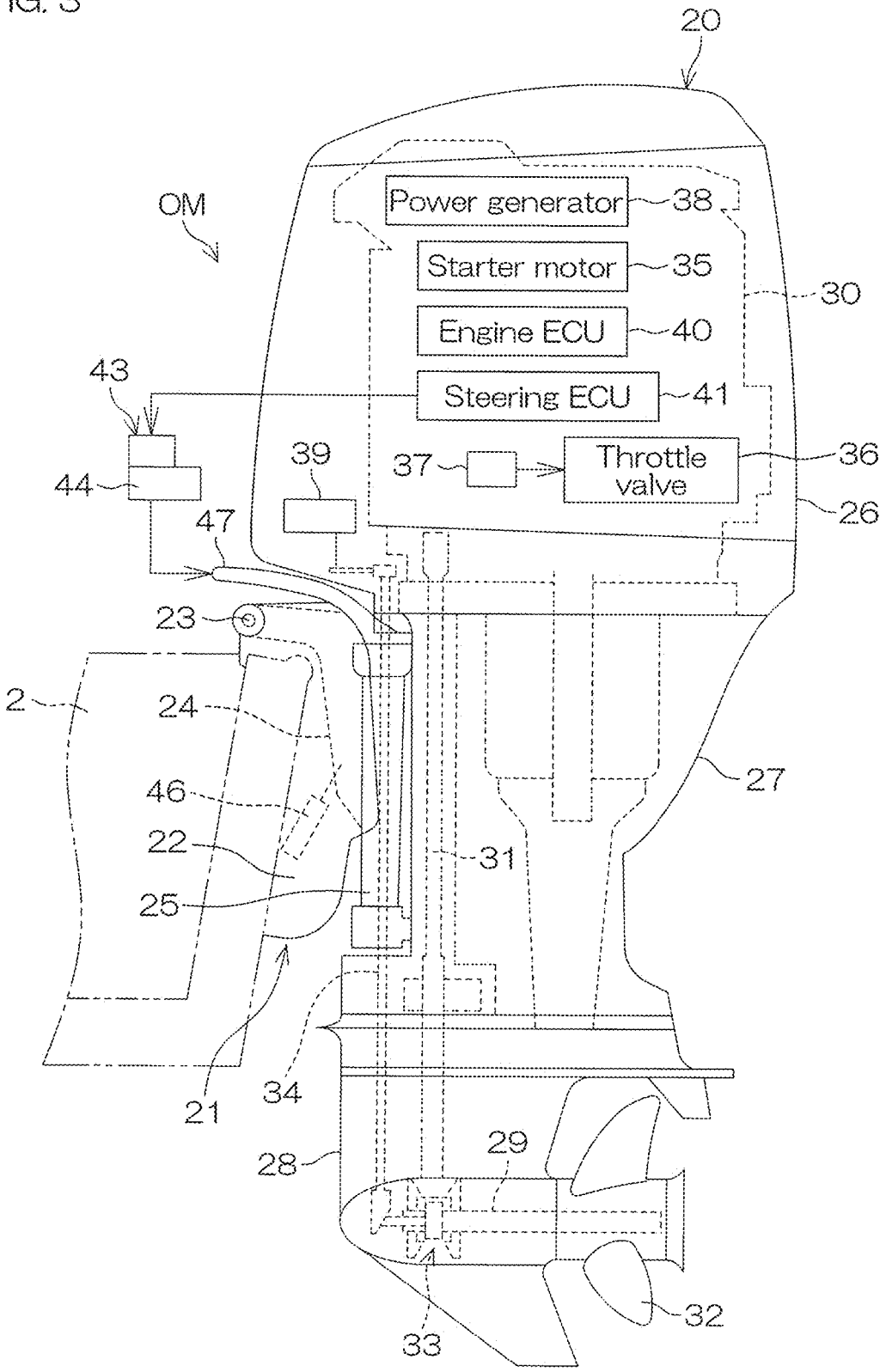
FIG. 3 is a side view showing the structure of an engine outboard motor by way of example.

FIG. 3 is a side view showing the structure of the engine outboard motor OM by way of example. The engine outboard motor OM includes a propulsion unit 20, and an attachment mechanism 21 that attaches the propulsion unit 20 to the hull 2. The attachment mechanism 21 includes a clamp bracket 22 detachably fixed to a transom plate provided on the stern 3 of the hull 2, and a swivel bracket 24 connected to the clamp bracket 22 pivotally about a tilt shaft 23 (horizontal pivot shaft). The propulsion unit 20 is attached to the swivel bracket 24 pivotally about a steering shaft 25. Thus, a steering angle (the azimuth angle of a propulsive force direction with respect to the center line of the hull 2) is changeable by pivoting the propulsion unit 20 about the steering shaft 25. Further, the trim angle of the propulsion unit 20 is changeable by pivoting the swivel bracket 24 about the tilt shaft 23. The trim angle is an angle at which the engine outboard motor OM is attached to the hull 2.

The housing of the propulsion unit 20 includes an engine cover (top cowling) 26, an upper case 27, and a lower case 28. An engine 30 is provided as a prime mover in the engine cover 26 with the axis of its crank shaft extending vertically. A drive shaft 31 for power transmission is connected to the lower end of the crank shaft of the engine 30, and extends vertically through the upper case 27 into the lower case 28.

A propeller 32 is provided as a propulsion member rotatably at the lower rear side of the lower case 28. A propeller shaft 29, which is the rotation shaft of the propeller 32, extends horizontally through the lower case 28. The rotation of the drive shaft 31 is transmitted to the propeller shaft 29 via a shift mechanism 33.

The shift mechanism 33 includes a plurality of shift positions (shift states) including a forward shift position, a reverse shift position, and a neutral shift position. The neutral shift position corresponds to a cutoff state in which the rotation of the drive shaft 31 is not transmitted to the propeller shaft 29. The forward shift position corresponds to a state such that the rotation of the drive shaft 31 is transmitted to the propeller shaft 29 so as to rotate the propeller shaft 29 in a forward drive rotation direction. The reverse shift position corresponds to a state such that the rotation of the drive shaft 31 is transmitted to the propeller shaft 29 so as to rotate the propeller shaft 29 in a reverse drive rotation direction. The forward drive rotation direction is such that the propeller 32 is rotated so as to apply a forward propulsive force to the hull 2. The reverse drive rotation direction is such that the propeller 32 is rotated so as to apply a reverse propulsive force to the hull 2. The shift position of the shift mechanism 33 is switched by a shift rod 34. The shift rod 34 extends vertically parallel to the drive shaft 31, and is configured so as to be pivoted about its axis to operate the shift mechanism 33.

A starter motor 35 to start the engine 30, and a power generator 38 to generate electric power by the power of the engine 30 after the startup of the engine 30 are provided in association with the engine 30. The starter motor 35 is controlled by an engine ECU (Electronic Control Unit) 40. The electric power generated by the power generator 38 is supplied to electric components provided in the engine outboard motor OM and, in addition, is used to charge batteries 130, 145 (see FIG. 6) accommodated in the hull 2 (see FIGS. 1 and 2). Further, a throttle actuator 37 is provided in association with the engine 30. The throttle actuator 37 actuates the throttle valve 36 of the engine 30 so as to change the throttle opening degree of the engine 30 to change the intake air amount of the engine 30. The throttle actuator 37 may be an electric motor. The operation of the throttle actuator 37 is controlled by the engine ECU 40.

A shift actuator 39 that changes the shift position of the shift mechanism 33 is provided in association with the shift rod 34. The shift actuator 39 is, for example, an electric motor, and the operation of the shift actuator 39 is controlled by the engine ECU 40.

Further, a steering rod 47 is fixed to the propulsion unit 20, and a steering device 43 to be driven according to the operation of the steering wheel 6 (see FIG. 1) is connected to the steering rod 47. The steering device 43 pivots the propulsion unit 20 about the steering shaft 25 to perform a steering operation. The steering device 43 includes a steering actuator 44. The steering actuator 44 is controlled by a steering ECU 41. The steering ECU 41 may be provided in the propulsion unit 20. The steering actuator 44 may be an electric motor, or may be a hydraulic actuator.

A tilt/trim actuator 46 is provided between the clamp bracket 22 and the swivel bracket 24. The tilt/trim actuator 46 includes, for example, a hydraulic cylinder, and is controlled by the engine ECU 40. The tilt/trim actuator 46 pivots the swivel bracket 24 about the tilt shaft 23 to pivot the propulsion unit 20 about the tilt shaft 23.

Figure 4:
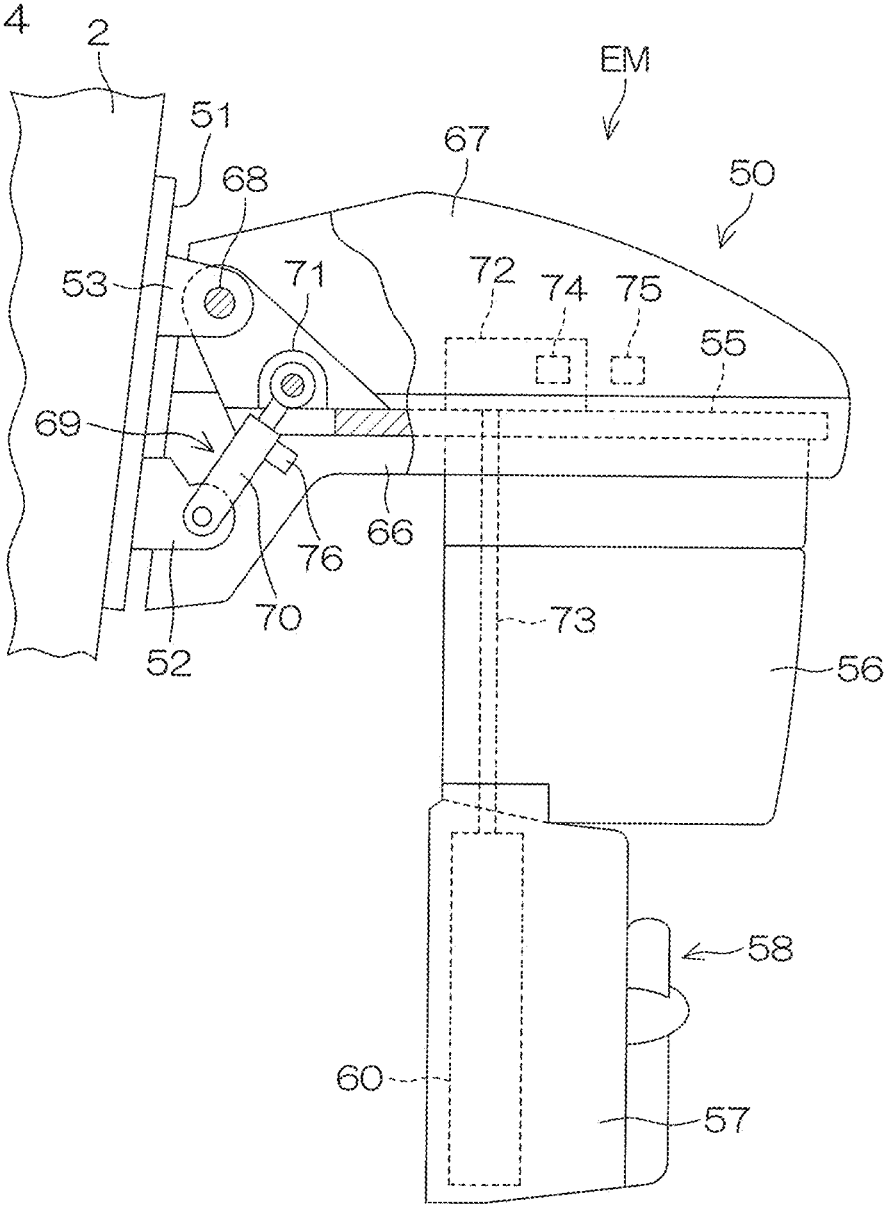
FIG. 4 is a side view showing the structure of an electric outboard motor by way of example.
Figure 5:
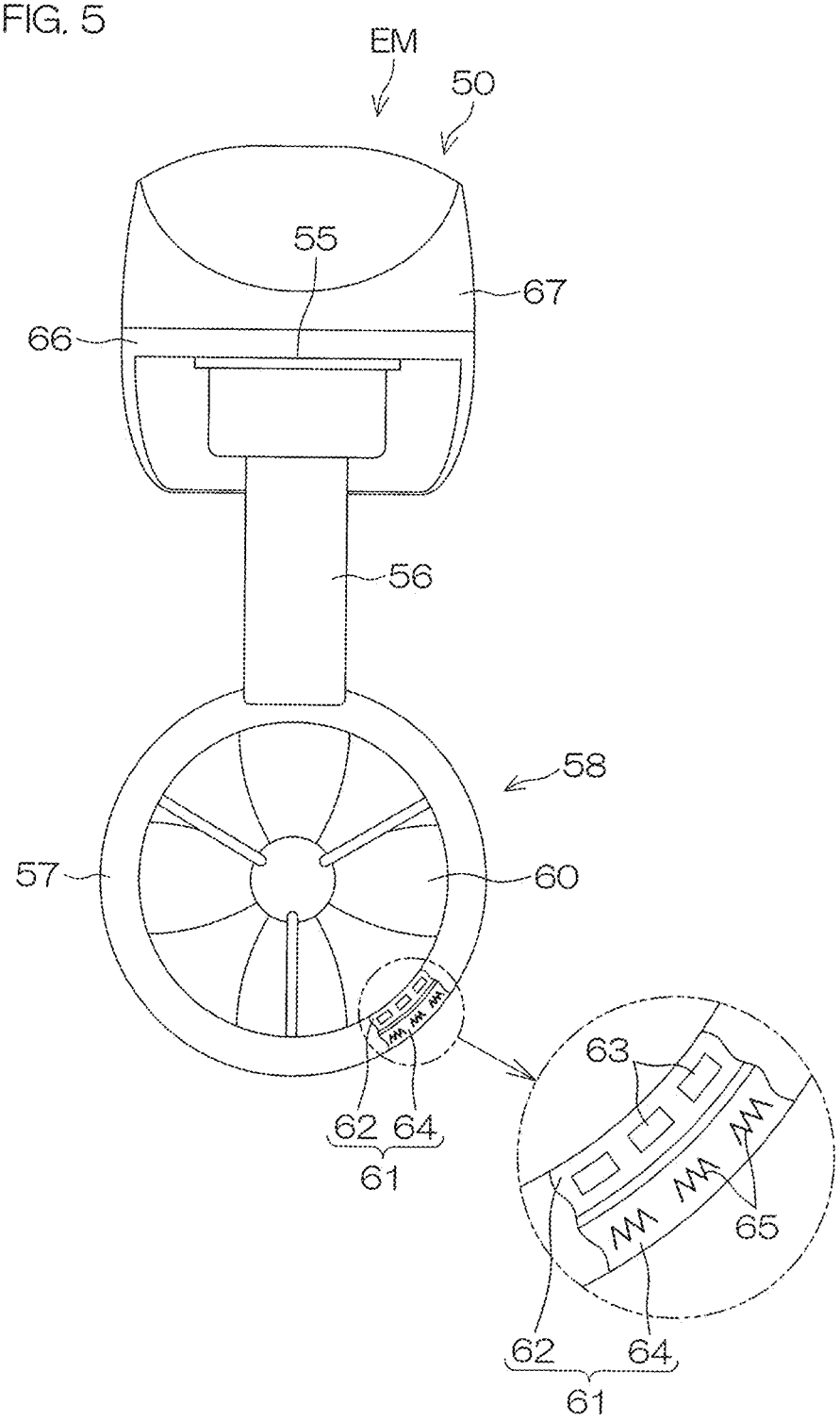
FIG. 5 is a rear view of the electric outboard motor as seen from a rear side of the watercraft.

FIG. 4 is a side view showing the structure of the electric outboard motor EM by way of example, and FIG. 5 is a rear view of the electric outboard motor EM as seen from the rear side of the watercraft 1.

The electric outboard motor EM includes a bracket 51 for attachment thereof to the hull 2, and a propulsion device body 50. The propulsion device body 50 is supported by the bracket 51. The propulsion device body 50 includes a base 55 supported by the bracket 51, an upper housing 56 extending downward from the base 55, a tubular (duct-shaped) lower housing 57 disposed below the upper housing 56, and a drive unit 58 disposed in the lower housing 57. The propulsion device body 50 further includes a cover 66 that covers the base 55 from the lower side, and a cowl 67 that covers the base 55 from the upper side. A tilt unit 69 and a steering unit 72 are accommodated in a space defined by the cover 66 and the cowl 67. Further, a buzzer 75 that generates sound when the tilt unit 69 is actuated may be accommodated in this space.

The drive unit 58 includes a propeller 60, and an electric motor 61 that rotates the propeller 60. The electric motor 61 includes a tubular rotor 62 to which the propeller 60 is fixed radially inward thereof, and a tubular stator 64 that surrounds the rotor 62 from the radially outside. The stator 64 is fixed to the lower housing 57, and the rotor 62 is supported rotatably with respect to the lower housing 57. The rotor 62 includes a plurality of permanent magnets 63 disposed circumferentially thereof. The stator 64 includes a plurality of coils 65 disposed circumferentially thereof. The rotor 62 is rotated by energizing the coils 65 such that the propeller 60 is correspondingly rotated to generate a propulsive force.

The tilt unit 69 includes a tilt cylinder 70 as a tilt actuator. The tilt cylinder 70 may be a hydraulic cylinder of electric pump type adapted to pump a hydraulic oil by an electric pump. One of opposite ends of the tilt cylinder 70 is connected to the lower support portion 52 of the bracket 51, and the other end of the tilt cylinder 70 is connected to the base 55 via a cylinder connection bracket 71. A tilt shaft 68 is supported by the upper support portion 53 of the bracket 51, and the base 55 is connected to the bracket 51 via the tilt shaft 68 pivotally about the tilt shaft 68. The tilt shaft 68 extends transversely of the hull 2 so that the base 55 is pivotable upward and downward. Thus, the propulsion device body 50 is pivotable upward and downward about the tilt shaft 68.

An expression "tilt-up" means that the propulsion device body 50 is pivoted upward about the tilt shaft 68, and an expression "tilt-down" means that the propulsion device body 50 is pivoted downward about the tilt shaft 68. The tilt cylinder 70 is driven to be extended and retracted such that the tilt-up and the tilt-down are achieved. The propeller 60 is moved up to an above-water position by the tilt-up such that the propulsion device body 50 is brought into a tilt-up state. Further, the propeller 60 is moved down to an underwater position by the tilt-down such that the propulsion device body 50 is brought into a tilt-down state. Thus, the tilt unit 69 is an example of the lift or lift device that moves up and down the propeller 60.

A tilt angle sensor 76 is provided to detect a tilt angle (i.e., the angle of the propulsion device body 50 with respect to the bracket 51) to detect the tilt-up state and the tilt-down state of the propulsion device body 50. The tilt angle sensor 76 may be a position sensor that detects the position of the actuation rod of the tilt cylinder 70.

The steering unit 72 includes a steering shaft 73 connected to the lower housing 57 and the upper housing 56, and a steering motor 74. The steering motor 74 is an example of a steering actuator that generates a drive force to pivot the steering shaft 73 about its axis. The steering unit 72 may further include a reduction gear that reduces the rotation speed of the steering motor 74 and transmits the rotation of the steering motor 74 to the steering shaft 73. Thus, the lower housing 57 and the upper housing 56 are pivoted about the steering shaft 73 by driving the steering motor 74 such that the direction of the propulsive force generated by the drive unit 58 is changeable leftward and rightward. The upper housing 56 has a plate shape that extents anteroposteriorly of the hull 2 in a neutral steering position, and functions as a rudder plate to be steered by the steering unit 72.

Figure 6:
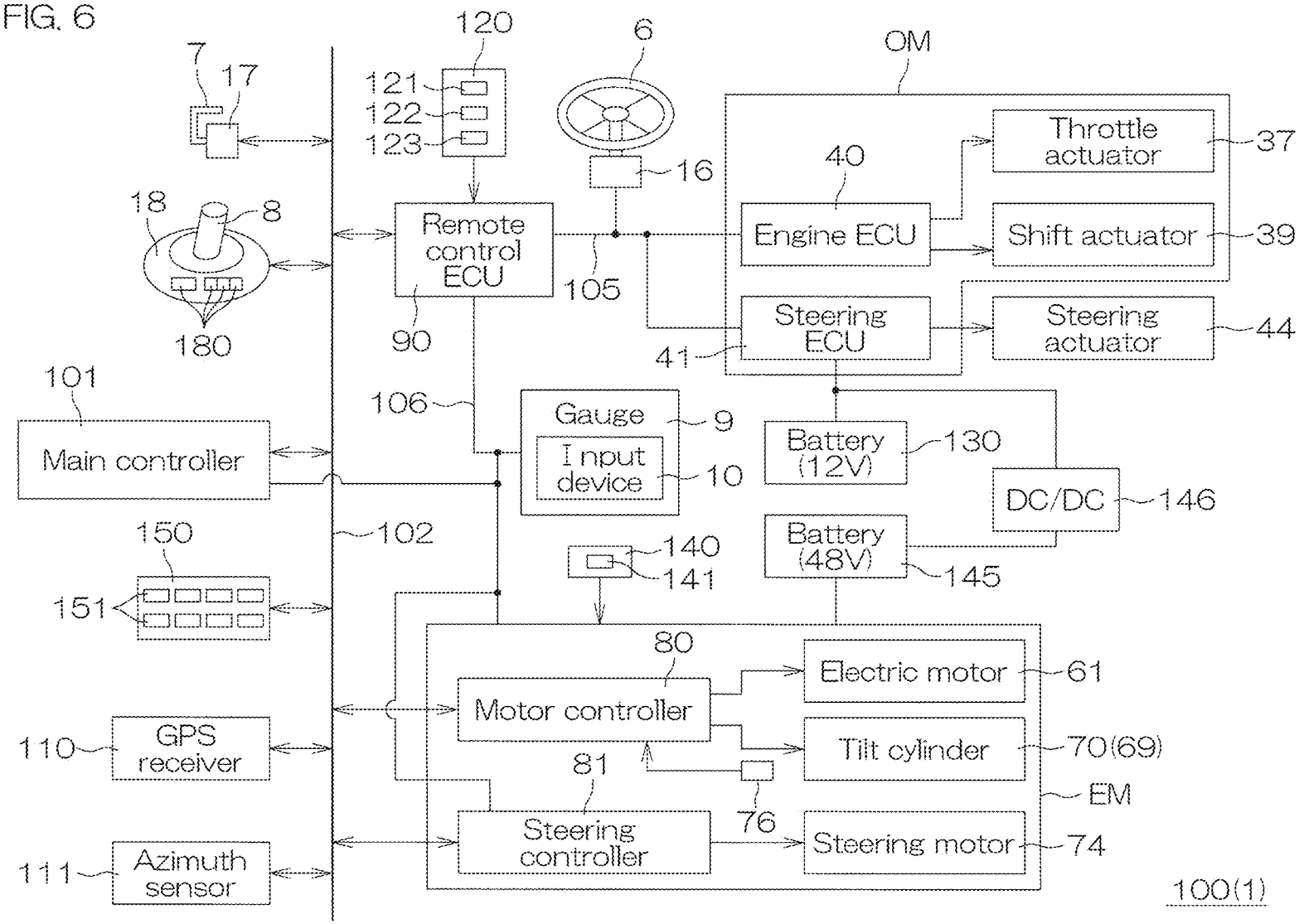
FIG. 6 is a block diagram showing the configuration of a watercraft propulsion system by way of example.

FIG. 6 is a block diagram showing an exemplary configuration of the watercraft propulsion system 100 provided in the watercraft 1. The watercraft propulsion system 100 includes the engine outboard motor OM as the main propulsion device, and the electric outboard motor EM as the auxiliary propulsion device. The watercraft propulsion system 100 includes the lift device to move up and down the propeller 60 of the electric outboard motor EM (see FIGS. 4 and 5) between the underwater position and the above-water position. In the present preferred embodiment, the tilt unit 69 provided in the electric outboard motor EM is an example of the lift device. The lift device such as the tilt unit 69 may be incorporated in the electric outboard motor EM, or may be provided separately from the electric outboard motor EM.

The watercraft propulsion system 100 includes a main controller 101. The main controller 101 is connected to an onboard network 102 (CAN: Control Area Network) provided in the hull 2. A remote control unit 17, a remote control ECU 90, a joystick unit 18, a GPS (Global Positioning System) receiver 110, an azimuth sensor 111, and the like are connected to the onboard network 102. The engine ECU 40 and the steering ECU 41 are connected to the remote control ECU 90 via an outboard motor control network 105. The main controller 101 transmits and receives signals to/from various units connected to the onboard network 102 to control the engine outboard motor OM and the electric outboard motor EM, and further controls other units. The main controller 101 includes a plurality of control modes, and controls the units in predetermined manners according to the respective control modes.

A steering wheel unit 16 is connected to the outboard motor control network 105. The steering wheel unit 16 outputs an operation angle signal indicating the operation angle of the steering wheel 6 to the outboard motor control network 105. The operation angle signal is received by the remote control ECU 90 and the steering ECU 41. In response to the operation angle signal generated by the steering wheel unit 16 or a steering angle command applied from the remote control ECU 90, the steering ECU 41 correspondingly controls the steering actuator 44 to control the steering angle of the engine outboard motor OM.

The remote control unit 17 generates an operation position signal indicating the operation position of the remote control lever 7.

The joystick unit 18 generates an operation position signal indicating the operation position of the joystick 8, and generates an operation signal when one of operation buttons 180 of the joystick unit 18 is operated.

The remote control ECU 90 outputs a propulsive force command to the engine ECU 40 via the outboard motor control network 105. The propulsive force command includes a shift command that indicates the shift position of the shift mechanism 33, and an output command that indicates the output (specifically, the rotation speed) of the engine 30. Further, the remote control ECU 90 outputs the steering angle command to the steering ECU 41 via the outboard motor control network 105.

The remote control ECU 90 performs different control operations according to different control modes of the main controller 101. In a control mode for watercraft maneuvering with the use of the steering wheel 6 and the remote control lever 7, for example, the propulsive force command (the shift command and the output command) is generated according to the operation position signal generated by the remote control unit 17, and is applied to the engine ECU 40 by the remote control ECU 90. Further, the remote control ECU 90 commands the steering ECU 41 to conform to the operation angle signal generated by the steering wheel unit 16. In a control mode for watercraft maneuvering without the use of the steering wheel 6 and the remote control lever 7, on the other hand, the remote control ECU 90 conforms to commands applied by the main controller 101. That is, the main controller 101 generates the propulsive force command (the shift command and the output command) and the steering angle command, which are outputted to the engine ECU 40 and the steering ECU 41, respectively, by the remote control ECU 90. In a control mode for watercraft maneuvering with the use of the joystick 8, for example, the main controller 101 generates the propulsive force command (the shift command and the output command) and the steering angle command according to the signals generated by the joystick unit 18. The magnitude and the direction (the forward direction or the reverse direction) of the propulsive force of the engine outboard motor OM and the steering angle of the engine outboard motor OM are controlled according to the propulsive force command (the shift command and the output command) and the steering angle command thus generated.

The engine ECU 40 drives the shift actuator 39 according to the shift command to control the shift position, and drives the throttle actuator 37 according to the output command to control the throttle opening degree. The steering ECU 41 controls the steering actuator 44 according to the steering angle command to control the steering angle of the engine outboard motor OM.

The electric outboard motor EM includes a motor controller 80 and a steering controller 81 connected to the onboard network 102, and is configured to be actuated in response to commands applied from the main controller 101. The main controller 101 applies a propulsive force command and a steering angle command to the electric outboard motor EM. The propulsive force command includes a shift command and an output command. The shift command is a rotation direction command that indicates the stop of the propeller 60, the forward drive rotation of the propeller 60, or the reverse drive rotation of the propeller 60. The output command indicates a propulsive force to be generated, specifically the target value of the rotation speed of the propeller 60. The steering angle command indicates the target value of the steering angle of the electric outboard motor EM. The motor controller 80 controls the electric motor 61 according to the shift command (rotation direction command) and the output command. The steering controller 81 controls the steering motor 74 according to the steering angle command.

Further, the main controller 101 applies a tilt command to the motor controller 80 via the onboard network 102. The tilt command indicates the target value of the tilt angle of the electric outboard motor EM. The motor controller 80 actuates the tilt cylinder 70 according to the tilt command to tilt up or down the electric outboard motor EM to the target tilt angle. The detection signal of the tilt angle sensor 76 is inputted to the motor controller 80. Thus, the motor controller 80 can acquire the information of the tilt angle of the propulsion device body 50, and transmit the tilt angle information to the main controller 101.

The GPS receiver 110 detects the position of the watercraft 1 by receiving radio waves from an artificial satellite orbiting the earth, and outputs position data indicating the position of the watercraft 1 and speed data indicating the moving speed of the watercraft 1. The main controller 101 acquires the position data and the speed data, which are used to control and display the position and/or the azimuth of the watercraft 1.

The azimuth sensor 111 detects the azimuth of the watercraft 1, and generates azimuth data, which is used by the main controller 101.

The gauge 9 is connected to the main controller 101 via a control panel network 106. The gauge 9 is a display device that displays various information for watercraft maneuvering. The gauge 9 is connected to the remote control ECU 90, the motor controller 80, and the steering controller 81 via the control panel network 106. Thus, the gauge 9 can display information such as of the operation state of the engine outboard motor OM, the operation state of the electric outboard motor EM, and the position and/or the azimuth of the watercraft 1. The gauge 9 may include an input device 10 such as a touch panel and buttons. The input device 10 may be operated by the operator to set various settings and give various commands such that operation signals are outputted to the control panel network 106.

A power switch unit 120 operable to turn on a power supply to the engine outboard motor OM and to start and stop the engine 30 is connected to the remote control ECU 90. The power switch unit 120 includes a power switch 121 operable to turn on and off the power supply to the engine outboard motor OM, a start switch 122 operable to start the engine 30, and a stop switch 123 operable to stop the engine 30.

With the power switch 121 turned on, the remote control ECU 90 performs a power supply control to control the power supply to the engine outboard motor OM. Specifically, a power supply relay (not shown) provided between the battery 130 (e.g., 12 V) and the engine outboard motor OM is turned on. When the start switch 122 is operated with the power supply to the engine outboard motor OM turned on, the remote control ECU 90 applies a start command to the engine ECU 40. Thus, the engine ECU 40 actuates the starter motor 35 (see FIG. 3) to start the engine 30. During the operation of the engine 30, the battery 130 is charged with the electric power generated by the power generator 38 (see FIG. 3). When the stop switch 123 is operated during the operation of the engine, the remote control ECU 90 applies an engine stop command to the engine ECU 40. In response to the engine stop command, the engine ECU 40 performs a stop control operation to stop the engine 30. Engine outboard motor state information indicating whether or not the power supply to the engine outboard motor OM is turned on and whether or not the engine 30 is in operation is applied to the main controller 101 via the onboard network 102 by the remote control ECU 90.

A power switch unit 140 operable to turn on and off a power supply to the electric outboard motor EM is connected to the electric outboard motor EM. By turning on and off a power switch 141 provided in the power switch unit 140, a circuit connected between the electric outboard motor EM and the battery 145 (e.g., 48 V) that supplies the electric power to the electric outboard motor EM is closed and opened to turn on and off the power supply to the electric outboard motor EM. Electric outboard motor state information indicating whether or not the electric outboard motor EM is turned on, i.e., whether or not the electric outboard motor EM is in a drivable state, is applied to the main controller 101 via the onboard network 102 by the motor controller 80. The battery 145 is able to receive the electric power generated by the power generator 38 (see FIG. 3) of the engine outboard motor OM via a DC/DC convertor 146 (voltage transformer).

Further, an application switch panel 150 is connected to the onboard network 102. The application switch panel 150 includes a plurality of function switches 151 operable to apply predefined function commands. For example, the function switches 151 may include switches for automatic watercraft maneuvering commands. Specific examples of the function switches 151 may include an automatic steering switch operable to maintain the azimuth of the watercraft 1, an automatic steering switch operable to maintain the course of the watercraft 1, an automatic steering switch operable to cause the watercraft 1 to pass through a plurality of checkpoints sequentially, and an automatic steering switch operable to cause the watercraft 1 to follow a predetermined traveling pattern (zig-zag pattern, spiral pattern or the like). A function for the tilt-up or the tilt-down of the electric outboard motor EM may be assigned to one of the function switches 151.

The main controller 101 is able to control the engine outboard motor OM and the electric outboard motor EM in a plurality of control modes. The control modes include a plurality of modes each defined by the state of the engine outboard motor OM and the state of the electric outboard motor EM. Specific examples of the control modes include an electric mode, an engine mode, a dual mode, and an extender mode. The main controller 101 operates according to any one of the control modes based on the engine outboard motor state information and the electric outboard motor state information.

In the electric mode, the power supply to the electric outboard motor EM is turned on, and the power supply to the engine outboard motor OM is turned off. That is, only the electric outboard motor EM generates the propulsive force in the electric mode. In the engine mode, the engine 30 is in operation with the power supply to the engine outboard motor OM turned on, and the power supply to the electric outboard motor EM is turned off. That is, only the engine outboard motor OM generates the propulsive force in the engine mode. In the dual mode and the extender mode, the power supply to the electric outboard motor EM is turned on, and the engine 30 of the engine outboard motor OM is in operation. In the dual mode, the propulsive force generated by the engine outboard motor OM and the propulsive force generated by the electric outboard motor EM are both utilized. In the extender mode, only the propulsive force generated by the electric outboard motor EM is utilized, and the engine 30 is driven to generate the electric power to charge the battery 145. In the electric mode and the extender mode, the electric outboard motor EM generates the propulsive force likewise. The operator may set a setting or give a command to select the dual mode or the extender mode. For example, the operator may operate the input device 10 provided in the gauge 9 to set the setting or give the command.

Figure 7:
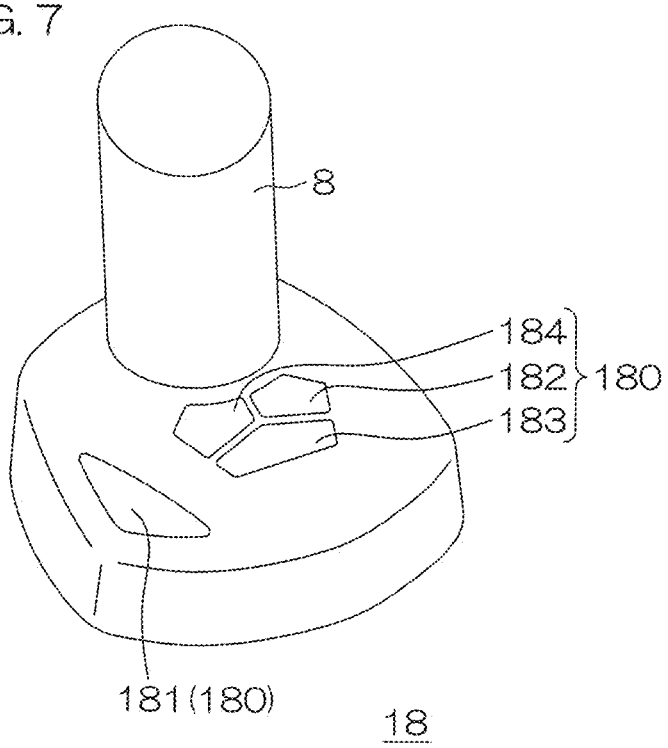
FIG. 7 is a perspective view showing the structure of a joystick unit by way of example.

FIG. 7 is a perspective view showing the structure of the joystick unit 18 by way of example. The joystick unit 18 includes the joystick 8, which is inclinable forward, backward, leftward, and rightward (i.e., in all 360-degree directions) and is pivotable (twistable) about its axis. In this example, the joystick unit 18 further includes a plurality of operation buttons 180. The operation buttons 180 include a joystick button 181 and holding mode setting buttons 182 to 184.

The joystick button 181 is an operation element operable by the operator to select a control mode (watercraft maneuvering mode) utilizing the joystick 8, i.e., a joystick mode.

The holding mode setting buttons 182, 183, 184 are operation buttons operable by the operator to select position/azimuth holding system control modes (examples of the holding mode). More specifically, the holding mode setting button 182 is operated to select a fixed point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

The control mode of the main controller 101 can be classified into an ordinary mode, the joystick mode, or the holding mode in terms of operation system.

In the ordinary mode, a steering control operation is performed according to the operation angle signal generated by the steering wheel unit 16, and a propulsive force control operation is performed according to the operation signal (operation position signal) of the remote control lever 7. In the present preferred embodiment, the ordinary mode is a default control mode of the main controller 101. In the steering control operation, specifically, the steering ECU 41 drives the steering actuator 44 according to the operation angle signal generated by the steering wheel unit 16 or the steering angle command applied from the remote control ECU 90. Thus, the body of the engine outboard motor OM is steered leftward and rightward such that the propulsive force direction is changed leftward and rightward with respect to the hull 2. In the propulsive force control operation, specifically, the engine ECU 40 drives the shift actuator 39 and the throttle actuator 37 according to the propulsive force command (the shift command and the output command) applied to the engine ECU 40 by the remote control ECU 90. Thus, the shift position of the engine outboard motor OM is set to the forward shift position, the reverse shift position, or the neutral shift position, and the engine output (specifically, the engine rotation speed) is changed.

In the joystick mode, the steering control operation and the propulsive force control operation are performed according to the operation signal of the joystick 8 of the joystick unit 18.

In the joystick mode, the steering control operation and the propulsive force control operation are performed on the engine outboard motor OM if the engine outboard motor OM is in a propulsive force generatable state. That is, the main controller 101 applies the steering angle command and the propulsive force command to the remote control ECU 90, and the remote control ECU 90 applies the steering angle command and the propulsive force command to the steering ECU 41 and the engine ECU 40, respectively.

In the joystick mode, the steering control operation and the propulsive force control operation are performed on the electric outboard motor EM if the electric outboard motor EM is in a propulsive force generatable state. In the steering control operation on the electric outboard motor EM, specifically, the steering controller 81 drives the steering unit 72 according to the steering angle command applied to the steering controller 81 of the electric outboard motor EM by the main controller 101. Thus, the drive unit 58 and the upper housing 56 of the electric outboard motor EM are pivoted leftward and rightward such that the propulsive force direction is changed leftward and rightward with respect to the hull 2. In the propulsive force control operation on the electric outboard motor EM, specifically, the motor controller 80 controls the rotation direction and the rotation speed of the electric motor 61 according to the propulsive force command (the shift command and the output command) applied to the motor controller 80 of the electric outboard motor EM by the main controller 101. Thus, the rotation direction of the propeller 60 is set to a forward drive rotation direction or a reverse drive rotation direction, and the rotation speed of the propeller 60 is changed.

Figure 8A:
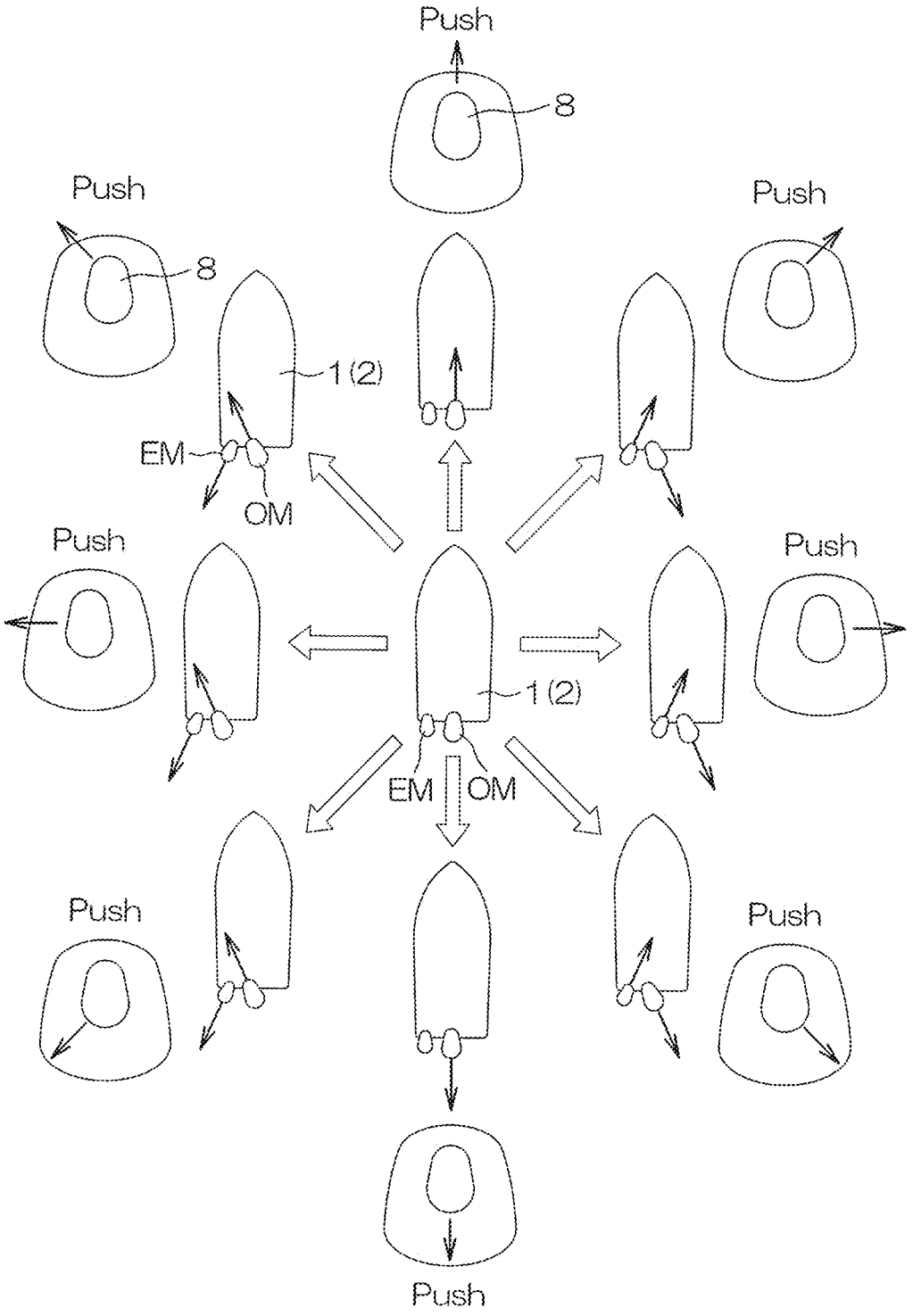
FIG. 8A is a diagram for describing an exemplary operation to be performed in a first joystick mode by utilizing the propulsive forces of two propulsion devices.
Figure 8B:
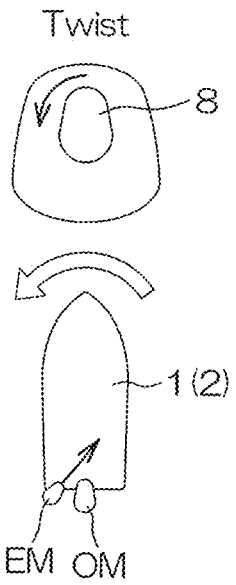
FIG. 8B is a diagram for describing another exemplary operation to be performed in the first joystick mode by utilizing the propulsive forces of the two propulsion devices.
Figure 8B:
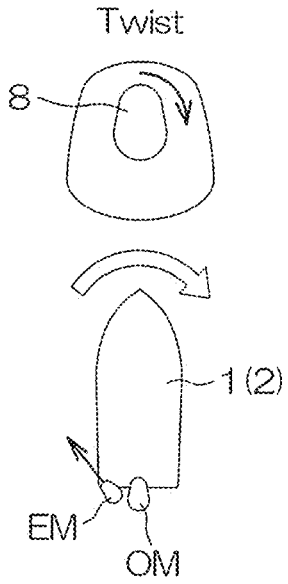
Figure 9:
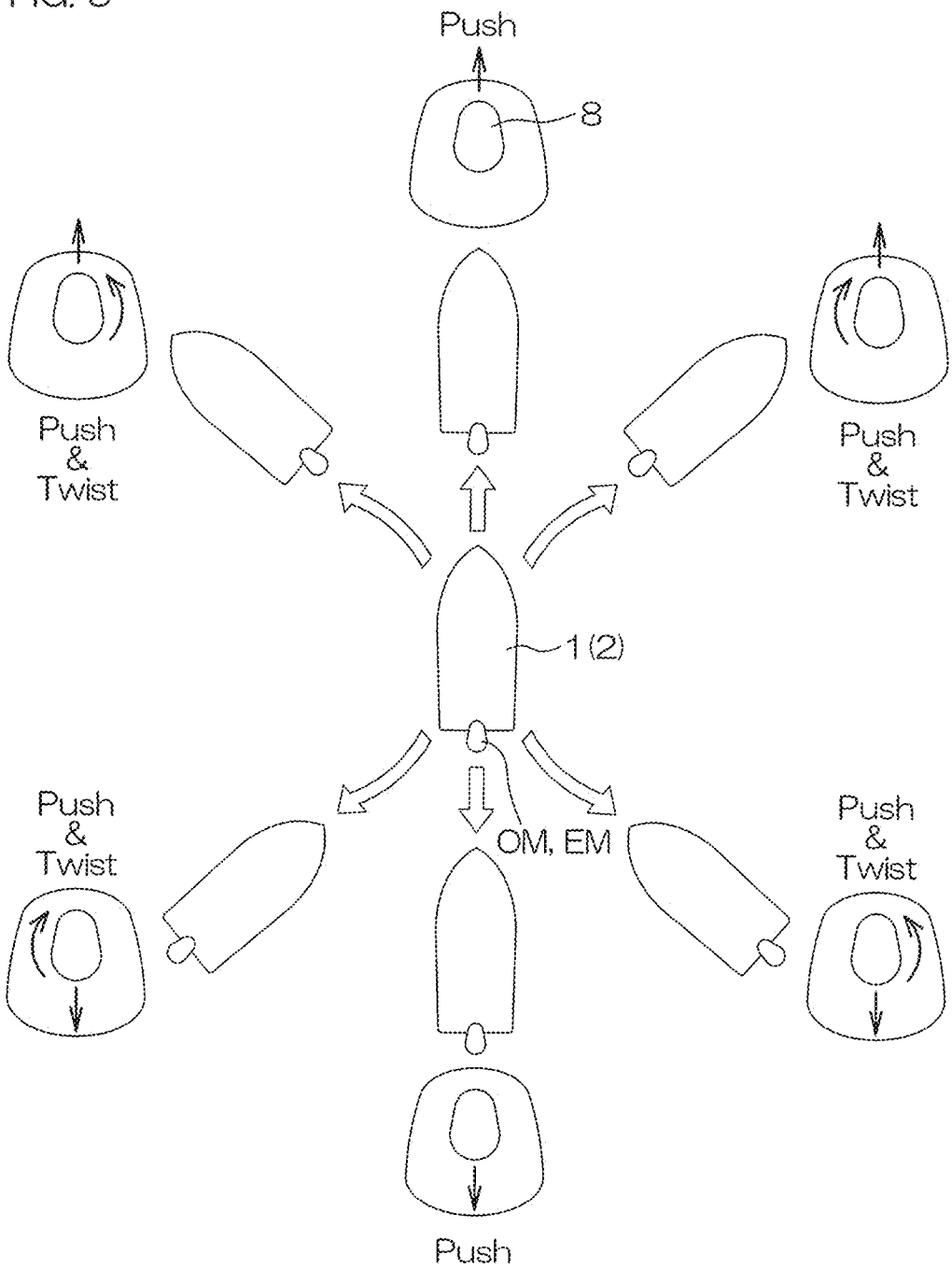
FIG. 9 is a diagram for describing an exemplary operation to be performed in a second joystick mode by utilizing the propulsive force of a single propulsion device.

FIGS. 8A, 8B, and 9 are diagrams for describing two types of joystick modes, and showing the operation states of the joystick 8 and the corresponding behaviors of the hull 2. More specifically, FIGS. 8A and 8B show exemplary operations to be performed in a first joystick mode in which propulsive forces generated by the two propulsion devices (in the present preferred embodiment, the engine outboard motor OM and the electric outboard motor EM) are both utilized. FIG. 9 shows an exemplary operation to be performed in a second joystick mode in which a propulsive force generated by only one of the propulsion devices (in the present preferred embodiment, one of the engine outboard motor OM and the electric outboard motor EM) is utilized.

When the joystick mode is commanded by operating the joystick button 181 in the dual mode, the main controller 101 performs the control operation according to the first joystick mode. When the joystick mode is commanded by operating the joystick button 181 in any one of the modes other than the dual mode (the electric mode, the engine mode or the extender mode), the main controller 101 performs the control operation in the second joystick mode.

In the first joystick mode shown in FIGS. 8A and 8B, the main controller 101 defines the inclination direction of the joystick 8 as an advancing direction command, and defines the inclination amount of the joystick 8 as a propulsive force magnitude command that indicates the magnitude of the propulsive force to be applied in the advancing direction. Further, the main controller 101 defines the pivoting direction of the joystick 8 about its axis (with respect to the neutral position of the joystick 8) as a bow turning direction command, and defines the pivoting amount of the joystick 8 (with respect to the neutral position of the joystick 8) as a bow turning speed command. For execution of these commands, the steering angle command and the propulsive force command are generated by the main controller 101 and inputted to the remote control ECU 90 and to the steering controller 81 and the motor controller 80 of the electric outboard motor EM. The remote control ECU 90 transmits the steering angle command and the propulsive force command to the steering ECU 41 and the engine ECU 40, respectively, of the engine outboard motor OM. Thus, the engine outboard motor OM is steered to a steering angle according to the steering command, and the shift position and the engine rotation speed of the engine outboard motor OM are controlled so as to generate a propulsive force according to the propulsive force command. Further, the drive unit 58 and the upper housing 56 of the electric outboard motor EM are steered to a steering angle according to the steering command, and the rotation direction and the rotation speed of the electric motor 61 of the electric outboard motor EM are controlled so as to generate a propulsive force according to the propulsive force command.

When the joystick 8 is inclined without being pivoted in the first joystick mode, the hull 2 is moved in a direction corresponding to the inclination direction of the joystick 8 without the bow turning, i.e., with its azimuth maintained. That is, the hull 2 is in a hull translation behavior. Examples of the hull translation behavior are shown in FIG. 8A. In general, the hull translation behavior is typically achieved by driving one of the two propulsion devices in a forward drive mode and driving the other propulsion device in a reverse drive mode with the propulsive force action lines of the two propulsion devices (extending along the respective propulsive force directions) crossing each other in the hull 2. Thus, the hull 2 translates in the direction of the resultant force of the propulsive forces generated by the two outboard motors OM, EM. Where the engine outboard motor OM and the electric outboard motor EM generate propulsive forces of the same magnitude with one of the outboard motors OM, EM driven in the forward drive mode and the other outboard motor driven in the reverse drive mode, for example, the hull 2 can translate laterally. In the examples shown in FIG. 8A, only the propulsive force of the engine outboard motor OM is utilized to move the hull 2 forward in the bow direction and rearward in the stern direction. When the joystick 8 is pivoted (twisted) without being inclined in the first joystick mode, the bow of the hull 2 is turned in a direction corresponding to the pivoting direction of the joystick 8 without any substantial position change. That is, the hull 2 is in a fixed-point bow turning behavior. Examples of the fixed-point bow turning behavior are shown in FIG. 8B. In these examples, only the propulsive force of the electric outboard motor EM is utilized for the fixed-point bow turning behavior.

When the joystick 8 is inclined and pivoted in the first joystick mode, the hull 2 is in a hull behavior such that the bow is turned in a direction corresponding to the pivoting direction of the joystick 8 while the hull 2 is moved in a direction corresponding to the inclination direction of the joystick 8. In general, however, the watercraft maneuvering operation can be more easily performed by inclining the joystick 8 for the hull translation behavior (see FIG. 8A) for the adjustment of the position of the hull 2 and by pivoting the joystick 8 for the fixed-point bow turning behavior (see FIG. 8B) for the adjustment of the azimuth of the hull 2.

In the second joystick mode shown in FIG. 9, the propulsive force generated by only one of the two propulsion devices is utilized and, therefore, the hull translation (see FIG. 8A) which utilizes the resultant force of the propulsive forces of the two propulsion devices is impossible. That is, the second joystick mode is a control mode that disables a certain hull behavior (specifically, the hull translation behavior) available in the first joystick mode. In the examples shown in FIG. 8B, only the propulsive force of the electric outboard motor EM is utilized, so that the fixed-point bow turning behavior is available not only in the dual mode but also in the electric mode and the extender mode.

In the second joystick mode, the main controller 101 defines the anteroposterior inclination of the joystick 8 as the propulsive force command (the shift command and the output command), and ignores the lateral inclination of the joystick 8. That is, when the joystick 8 is inclined, only the anteroposterior directional component of the inclination direction of the joystick 8 serves as an effective input, and is defined as the propulsive force command. More specifically, if the anteroposterior directional component has a value indicating the forward inclination, the anteroposterior directional component is defined as a forward shift command. If the anteroposterior directional component has a value indicating the rearward inclination, the anteroposterior directional component is defined as a reverse shift command. Further, the magnitude of the anteroposterior directional component is defined as a command (output command) indicating the magnitude of the propulsive force. The propulsive force command (the shift command and the output command) thus defined is inputted from the main controller 101 to the remote control ECU 90 (in the engine mode) or to the motor controller 80 (in the electric mode or the extender mode). On the other hand, the main controller 101 defines the axial pivoting of the joystick 8 as the steering angle command in the second joystick mode. That is, the main controller 101 generates the steering angle command according to the axial pivoting direction and the pivoting amount of the joystick 8, and inputs the steering angle command to the remote control ECU 90 (in the engine mode) or to the steering controller 81 (in the electric mode or the extender mode).

In the engine mode, the remote control ECU 90 transmits the steering angle command and the propulsive force command to the steering ECU 41 and the engine ECU 40, respectively. Thus, the engine outboard motor OM is steered to a steering angle according to the steering angle command, and the shift position and the engine rotation speed of the engine outboard motor OM are controlled so as to generate a propulsive force according to the propulsive force command. In the electric mode or the extender mode, the motor controller 80 drives the electric motor 61 according to the propulsive force command, and the steering controller 81 drives the steering motor 74 according to the steering angle command.

The fixed point holding mode (Stay Point™), the position holding mode (Fish Point™) and the azimuth holding mode (Drift Point™) to be selected by operating the holding mode setting buttons 182, 183 and 184, respectively, are examples of the holding mode. In these holding modes, the outputs and the steering angles of the engine outboard motor OM and/or the electric outboard motor EM are controlled without any manual operation by the operator.

In the fixed point holding mode (Stay Point™), for example, the main controller 101 controls the outputs and the steering angles of the engine outboard motor OM and the electric outboard motor EM based on the position data and the speed data generated by the GPS receiver 110 and the azimuth data outputted from the azimuth sensor 111. Thus, the positional change and the azimuthal change of the hull 2 are reduced. The fixed point holding mode, which is available in the dual mode, is an example of the combined use mode.

In the position holding mode (Fish Point™), the main controller 101 controls the output and the steering angle of at least one of the engine outboard motor OM and the electric outboard motor EM based on the position data and the speed data generated by the GPS receiver 110. Thus, the positional change of the hull 2 is reduced.

In the azimuth holding mode (Drift Point™), the main controller 101 controls the output and the steering angle of at least one of the engine outboard motor OM and the electric outboard motor EM based on the azimuth data generated by the azimuth sensor 111. Thus, the azimuthal change of the hull 2 is reduced.

The position holding mode and the azimuth holding mode are available in any of the electric mode, the engine mode, the dual mode, and the extender mode. The position holding mode and the azimuth holding mode in the dual mode are examples of the combined use mode.

The holding mode setting buttons 182, 183, 184 are examples of the command input operable to command to switch to the holding mode. Further, the holding mode setting buttons 182, 183, 184 are examples of the command input operable to command to switch to the combined use mode.

Figure 10:
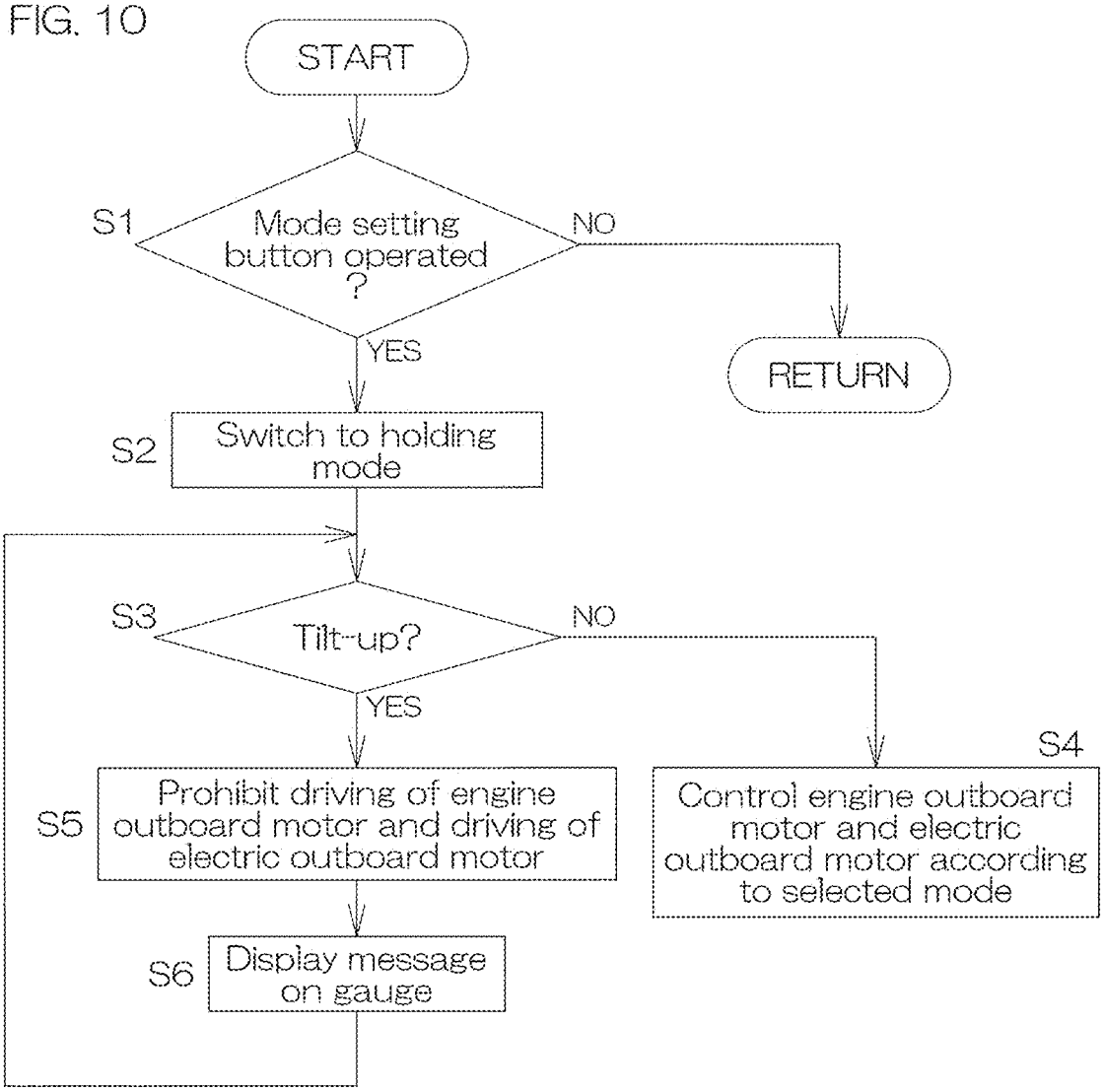
FIG. 10 is a flowchart for describing an exemplary operation to be performed when a holding mode is commanded.

FIG. 10 is a flowchart for describing an exemplary operation to be performed when the holding mode is commanded.

When the operator operates one of the holding mode setting buttons 182 to 184 (YES in Step S1), the main controller 101 is commanded to select a corresponding one of the holding modes, i.e., the fixed point holding mode, the position holding mode, or the azimuth holding mode. In response to the command, the control mode of the main controller 101 is switched to the selected holding mode (Step S2).

In the selected holding mode, the main controller 101 determines whether or not the electric outboard motor EM is in the tilt-up state, i.e., whether or not the propeller 60 is located in the above-water position (Step S3). Specifically, the main controller 101 acquires the tilt angle information of the propulsion device body 50 from the motor controller 80 and determines, based on the tilt angle information, whether or not the electric outboard motor EM is in the tilt-up state.

If the electric outboard motor EM is not in the tilt-up state (NO in Step S3), i.e., if the electric outboard motor EM is in the tilt-down state with its propeller 60 located in the underwater position, the main controller 101 controls the engine outboard motor OM and/or the electric outboard motor EM according to the selected holding mode (Step S4).

If the electric outboard motor EM is in the tilt-up state (YES in Step S3), the main controller 101 prohibits the driving of the engine outboard motor OM and the electric outboard motor EM (Step S5). Specifically, the main controller 101 suspends the output of the propulsive force command and the steering angle command according to the holding mode, and maintains both the engine outboard motor OM and the electric outboard motor EM in a stop state. Further, the main controller 101 causes the gauge 9 to display a message indicating that the electric outboard motor EM should be tilted down (Step S6). This message may be such that the holding mode control is suspended because the electric outboard motor EM is in the tilt-up state.

The operator performs an electric outboard motor tilt-down operation to tilt down the electric outboard motor EM. Thus, the electric outboard motor EM is brought into the tilt-down state with its propeller 60 located in the underwater position (NO in Step S3), and then the main controller 101 starts the driving of the engine outboard motor OM and the electric outboard motor EM according to the selected holding mode (Step S4). That is, the propulsive force command and the steering angle command according to the selected holding mode are applied to the engine outboard motor OM and the electric outboard motor EM.

The electric outboard motor tilt-down operation may be a switch operation to be performed on the application switch panel 150 as described above. In response to this operation, the main controller 101 applies a tilt-down command to the motor controller 80. In response to the tilt-down command, the motor controller 80 drives the tilt unit 69 to tilt down the electric outboard motor EM. When the motor controller 80 tilts up and down the electric outboard motor EM, the electric outboard motor EM may sound the buzzer 75 (see FIG. 4) provided therein. This may also apply to exemplary operations to be described with reference to FIGS. 11 to 13.

According to this exemplary operation, it is determined, in the holding mode, whether or not the electric outboard motor EM is in the tilt-up state and, if the electric outboard motor EM is in the tilt-up state, the driving of the engine outboard motor OM and the electric outboard motor EM is prohibited. Thus, when the propeller 60 of the electric outboard motor EM is not located in the underwater position and thus the electric outboard motor EM cannot effectively generate the propulsive force, the useless driving of the electric outboard motor EM is restricted. Even if only the engine outboard motor OM generates the propulsive force, it is impossible to achieve the hull behavior as intended by the selected holding mode. Therefore, the driving of the engine outboard motor OM is also prohibited. Thus, the useless driving of the engine outboard motor OM is restricted. In other words, the driving of the engine outboard motor OM and the electric outboard motor EM is permitted on condition that the electric outboard motor EM is in the tilt-down state such that the hull behavior is achieved as intended by the selected holding mode from the beginning.

Figure 11:
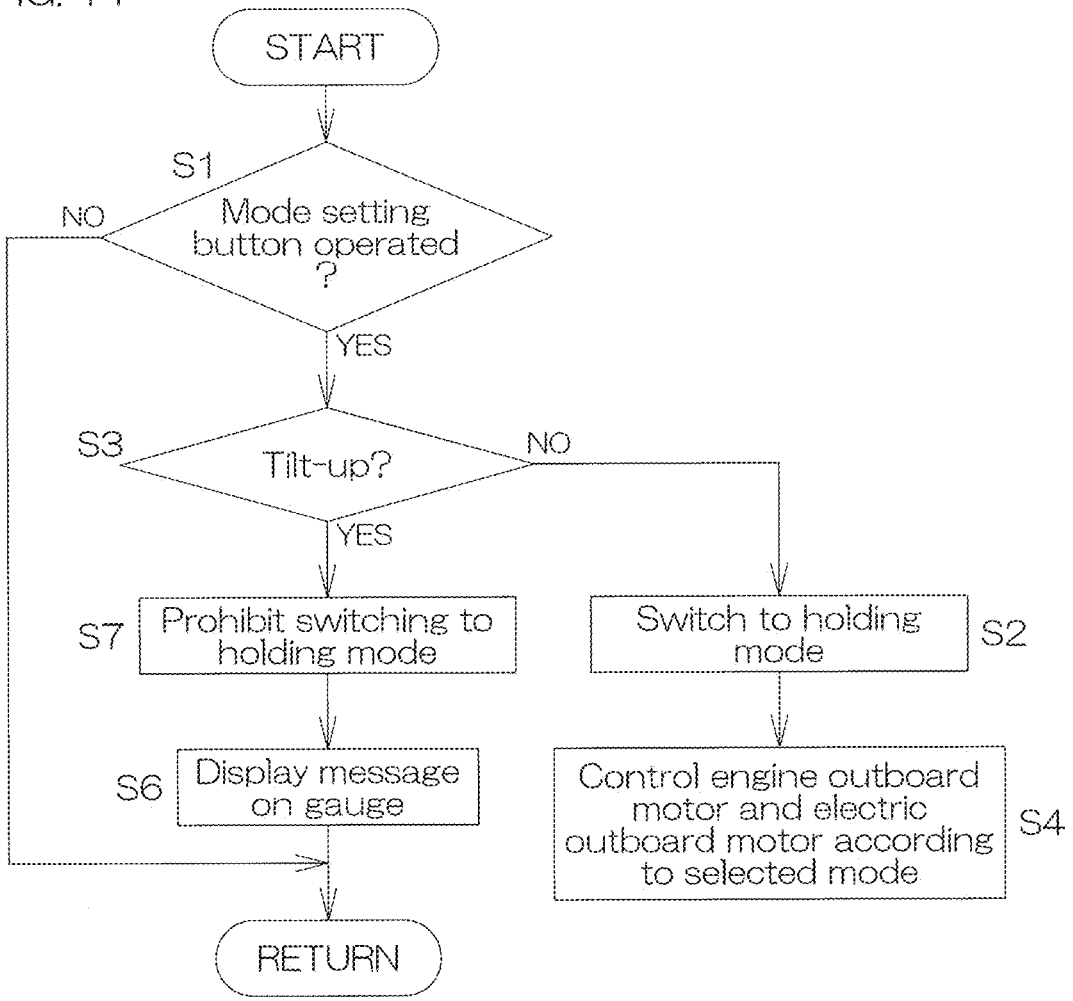
FIG. 11 is a flowchart for describing another exemplary operation to be performed when the holding mode is commanded.

FIG. 11 is a flowchart for describing another exemplary operation to be performed when the holding mode is commanded. In FIG. 11, the same process steps as in FIG. 10 are designated by the same reference characters.

When the operator operates one of the holding mode setting buttons 182 to 184 (YES in Step S1), the main controller 101 is commanded to select a corresponding one of the holding modes, i.e., the fixed point holding mode, the position holding mode, or the azimuth holding mode.

Before the control mode is switched to the selected holding mode, the main controller 101 determines whether or not the electric outboard motor EM is in the tilt-up state, i.e., whether or not the propeller 60 is located in the above-water position (Step S3). If the electric outboard motor EM is not in the tilt-up state (NO in Step S3), i.e., if the electric outboard motor EM is in the tilt-down state with its propeller 60 located in the underwater position, the main controller 101 is switched to the selected holding mode (Step S2), and controls the engine outboard motor OM and/or the electric outboard motor EM according to the selected holding mode (Step S4).

If the electric outboard motor EM is in the tilt-up state (YES in Step S3), the main controller 101 prohibits the switching to the selected holding mode (Step S7). Therefore, the propulsive force command and the steering angle command according to the selected holding mode are not outputted. The control mode is typically switched to the holding mode, for example, on condition that neither the engine outboard motor OM nor the electric outboard motor EM is driven to generate the propulsive force. If this condition is satisfied but the electric outboard motor EM is in the tilt-up state, the switching to the holding mode is prohibited. By thus prohibiting the switching to the holding mode, the engine outboard motor OM and the electric outboard motor EM are both maintained in the stop state. Further, the main controller 101 causes the gauge 9 to display a message indicating that the electric outboard motor EM should be tilted down (Step S6). This message may be such that the switching to the holding mode is suspended because the electric outboard motor EM is in the tilt-up state.

The operator performs the electric outboard motor tilt-down operation to tilt down the electric outboard motor EM such that the electric outboard motor EM is brought into the tilt-down state with its propeller 60 located in the underwater position. In this state, the operator operates the one of the holding mode setting buttons 182 to 184 again. Then, the determination in Step S3 is negative. Therefore, the main controller 101 is switched to the selected holding mode (Step S2), and starts the driving of the engine outboard motor OM and the electric outboard motor EM according to the selected holding mode (Step S4). That is, the propulsive force command and the steering angle command according to the holding mode are applied to the engine outboard motor OM and the electric outboard motor EM.

According to this exemplary operation, when the holding mode is commanded, the main controller 101 determines whether or not the electric outboard motor EM is in the tilt-up state and, if the electric outboard motor EM is in the tilt-up state, the switching to the holding mode is prohibited. Thus, the exemplary operation shown in FIG. 11 can provide the same effects as the exemplary operation shown in FIG. 10.

Figure 12:
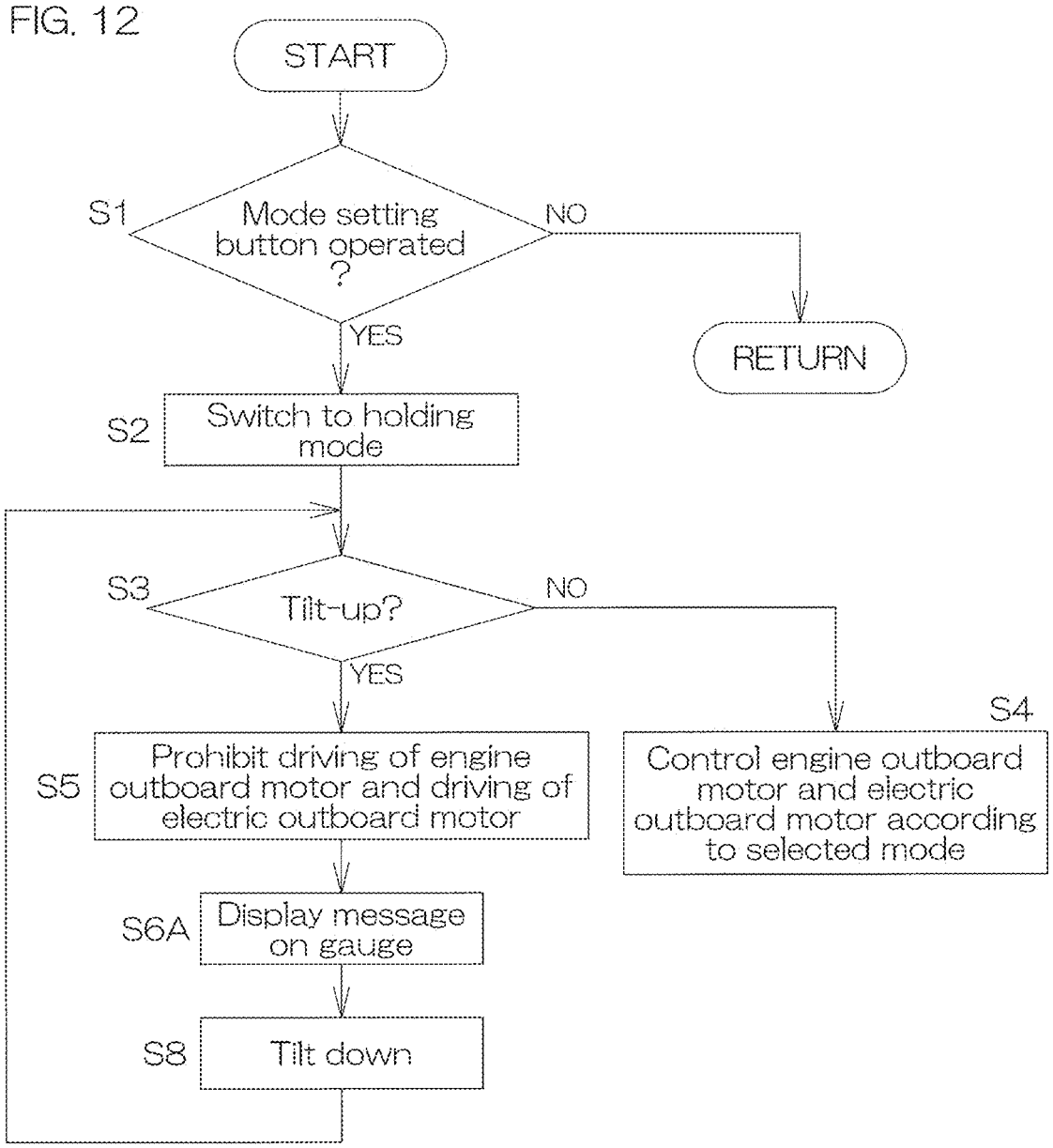
FIG. 12 is a flowchart for describing another further exemplary operation to be performed when the holding mode is commanded.

FIG. 12 is a flowchart for describing another further exemplary operation to be performed when the holding mode is commanded. In FIG. 12, the same process steps as in FIG. 10 are designated by the same reference characters.

When the operator operates one of the holding mode setting buttons 182 to 184 (YES in Step S1), the main controller 101 is commanded to select a corresponding one of the holding modes, i.e., the fixed point holding mode, the position holding mode, or the azimuth holding mode. In response to the command, the control mode of the main controller 101 is switched to the selected holding mode (Step S2).

In the selected holding mode, the main controller 101 determines whether or not the electric outboard motor EM is in the tilt-up state, i.e., whether or not the propeller 60 is located in the above-water position (Step S3).

If the electric outboard motor EM is not in the tilt-up state (NO in Step S3), i.e., if the electric outboard motor EM is in the tilt-down state with its propeller 60 located in the underwater position, the main controller 101 controls the engine outboard motor OM and/or the electric outboard motor EM according to the selected holding mode (Step S4).

If the electric outboard motor EM is in the tilt-up state (YES in Step S3), the main controller 101 prohibits the driving of the engine outboard motor OM and the electric outboard motor EM (Step S5). Specifically, the main controller 101 suspends the output of the propulsive force command and the steering angle command according to the holding mode, and maintains both the engine outboard motor OM and the electric outboard motor EM in the stop state. Further, the main controller 101 causes the gauge 9 to display a message indicating that the automatic tilt-down of the electric outboard motor EM is started and the holding mode control is suspended until the automatic tilt-down is completed (Step S6A).

Then, the main controller 101 applies the tilt-down command to the motor controller 80 (Step S8). In response to the tilt-down command, the motor controller 80 drives the tilt cylinder 70 to tilt down the electric outboard motor EM. During the tilt-down, the motor controller 80 may sound the buzzer 75 provided in the electric outboard motor EM.

After the tilt-down of the electric outboard motor EM is completed with the propeller 60 of the electric outboard motor EM located in the underwater position (NO in Step S3), the main controller 101 starts the driving of the engine outboard motor OM and the electric outboard motor EM according to the selected holding mode (Step S4). That is, the main controller 101 applies the propulsive force command and the steering angle command according to the holding mode to the engine outboard motor OM and the electric outboard motor EM.

According to this exemplary operation, it is determined, in the holding mode, whether or not the electric outboard motor EM is in the tilt-up state and, if the electric outboard motor EM is in the tilt-up state, the driving of the engine outboard motor OM and the electric outboard motor EM is prohibited. Thus, the exemplary operation shown in FIG. 12 can provide the same effects as the exemplary operation shown in FIG. 10.

In this exemplary operation, the electric outboard motor EM is automatically tilted down by commanding the holding mode. After the completion of the tilt-down, the engine outboard motor OM and the electric outboard motor EM are driven according to the holding mode. Therefore, the operator can command the holding mode without considering whether or not the electric outboard motor EM is in the tilt-up state, and can drive the engine outboard motor OM and the electric outboard motor EM according to the holding mode without performing an additional operation for the tilt-down.

Figure 13:
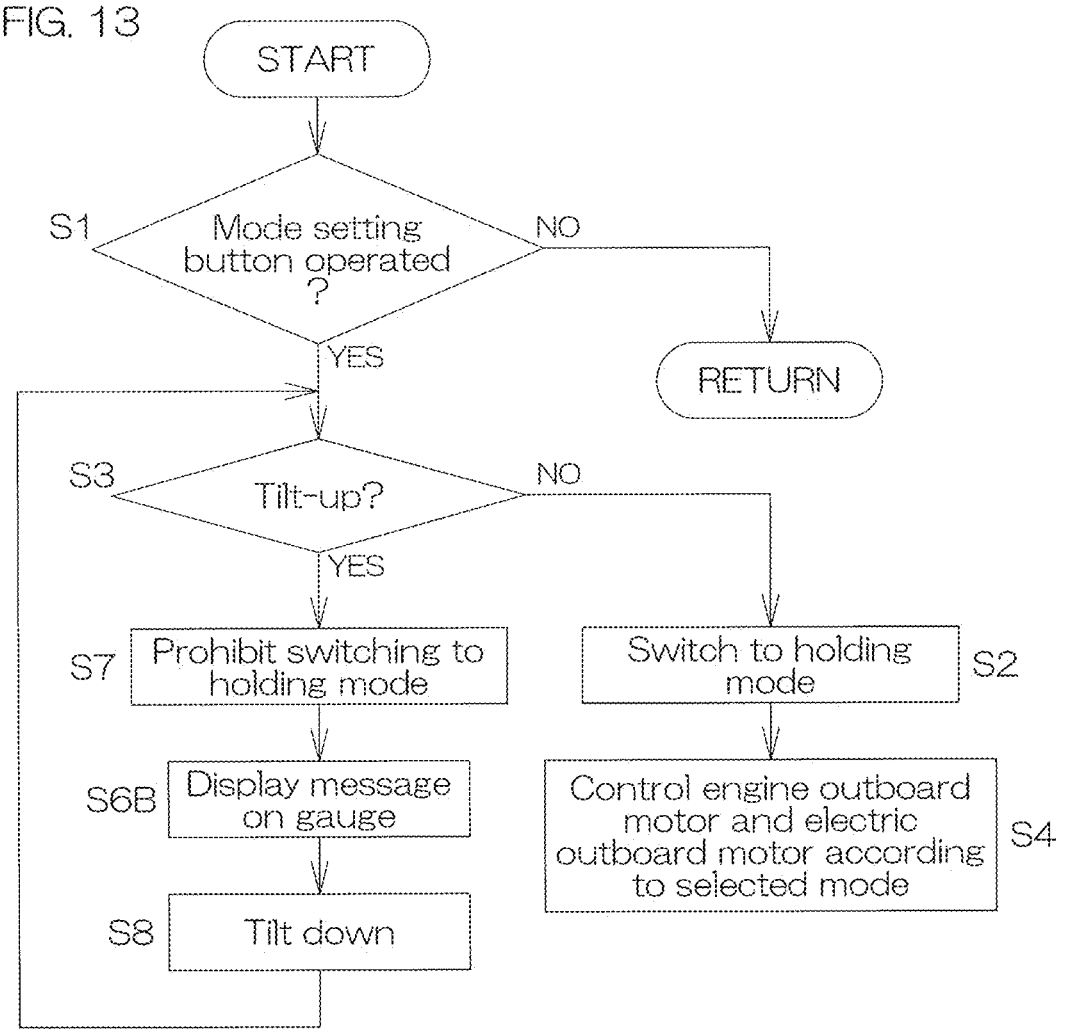
FIG. 13 is a flowchart for describing still another exemplary operation to be performed when the holding mode is commanded.

FIG. 13 is a flowchart for describing still another exemplary operation to be performed when the holding mode is commanded. In FIG. 13, the same process steps as in FIGS. 10 to 12 are designated by the same reference characters.

When the operator operates one of the holding mode setting buttons 182 to 184 (YES in Step S1), the main controller 101 is commanded to select a corresponding one of the holding modes, i.e., the fixed point holding mode, the position holding mode, or the azimuth holding mode.

Before the control mode is switched to the selected holding mode, the main controller 101 determines whether or not the electric outboard motor EM is in the tilt-up state, i.e., whether or not the propeller 60 is located in the above-water position (Step S3). If the electric outboard motor EM is not in the tilt-up state (NO in Step S3), i.e., if the electric outboard motor EM is in the tilt-down state with its propeller 60 located in the underwater position, the main controller 101 is switched to the selected holding mode (Step S2), and controls the engine outboard motor OM and/or the electric outboard motor EM according to the selected holding mode (Step S4).

If the electric outboard motor EM is in the tilt-up state (YES in Step S3), the main controller 101 prohibits the switching to the selected holding mode (Step S7). Therefore, the propulsive force command and the steering angle command according to the holding mode are not outputted. The control mode is typically switched to the holding mode, for example, on condition that neither the engine outboard motor OM nor the electric outboard motor EM is driven to generate the propulsive force. If this condition is satisfied but the electric outboard motor EM is in the tilt-up state, the switching to the holding mode is prohibited. By thus prohibiting the switching to the holding mode, the engine outboard motor OM and the electric outboard motor EM are both maintained in the stop state.

Further, the main controller 101 causes the gauge 9 to display a message indicating that the automatic tilt-down of the electric outboard motor EM is started and the switching to the holding mode is suspended until the tilt-down is completed (Step S6B).

Then, the main controller 101 applies the tilt-down command to the motor controller 80 (Step S8). In response to the tilt-down command, the motor controller 80 drives the tilt cylinder 70 to tilt down the electric outboard motor EM. During the tilt-down, the motor controller 80 may sound the buzzer 75 provided in the electric outboard motor EM.

After the tilt-down of the electric outboard motor EM is completed with the propeller 60 of the electric outboard motor EM located in the underwater position (NO in Step S3), the main controller 101 is switched to the selected holding mode (Step S2). Then, the main controller 101 starts the driving of the engine outboard motor OM and the electric outboard motor EM according to the selected holding mode (Step S4). That is, the propulsive force command and the steering angle command according to the holding mode are applied to the engine outboard motor OM and the electric outboard motor EM.

According to this exemplary operation, when the holding mode is commanded, the main controller 101 determines whether or not the electric outboard motor EM is in the tilt-up state and, if the electric outboard motor EM is in the tilt-up state, the switching to the holding mode is prohibited. Thus, the exemplary operation shown in FIG. 13 can provide the same effects as the exemplary operation shown in FIG. 10.

By thus commanding the holding mode, the electric outboard motor EM is automatically tilted down. After the completion of the tilt-down, the engine outboard motor OM and the electric outboard motor EM are driven according to the holding mode. Thus, the exemplary operation shown in FIG. 13 can provide the same effects as the exemplary operation shown in FIG. 12.

Whether or not to use the automatic tilt-down function for the automatic tilt-down of the electric outboard motor EM when the holding mode is commanded may be set by the operator, for example, by operating the input device 10. In this case, if the use of the automatic tilt-down function is not selected, the exemplary operation shown in FIG. 10 or 11 may be used. If the use of the automatic tilt-down function is selected, the exemplary operation shown in FIG. 12 or 13 may be used.

While preferred embodiments of the present invention have thus been described, the present invention may be embodied in some other ways.

For example, the above-described control operation may be used not only when the holding mode is commanded but also when the joystick mode is commanded in the dual mode to perform the control operation in the first joystick mode (see FIG. 8A). That is, the control operation may be performed by determining whether or not the electric outboard motor EM is in the tilt-up state, and prohibiting the driving of the engine outboard motor OM and the electric outboard motor EM if the electric outboard motor EM is in the tilt-up state.

When the electric outboard motor EM is in the tilt-up state, the maximum outputs of the engine outboard motor OM and the electric outboard motor EM may be limited so as to drive the engine outboard motor OM and/or the electric outboard motor EM at a lower output, without prohibiting the driving of the engine outboard motor OM and/or the electric outboard motor EM.

Further, the main propulsion device is not necessarily required to be the engine propulsion device adapted to be driven by the engine, but an electric propulsion device having a relatively high output may be used as the main propulsion device. Similarly, the auxiliary propulsion device is not necessarily required to be the electric propulsion device, but an engine propulsion device having a relatively low output may be used as the auxiliary propulsion device.

Further, the watercraft propulsion system may include two or more main propulsion devices. Similarly, the watercraft propulsion system may include two or more auxiliary propulsion devices.

The propulsion devices are not necessarily required to be attached to the stern 3, but an auxiliary propulsion device such as a trolling motor may be attached to the bow or other portion of the hull.

In a preferred embodiment described above, the outboard motors are used as the propulsion devices by way of example, but inboard motors, inboard/outboard motors (stern drives), waterjet propulsion devices and other types of propulsion devices may be employed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

a main propulsion device attachable to a hull;

an auxiliary propulsion device attachable to the hull and having a lower rated output than the main propulsion device;

a lift to move up and down a propeller of the auxiliary propulsion device between an underwater position and an above-water position; and a controller including a plurality of control modes including a combined use mode in which a propulsive force generated by the main propulsion device and a propulsive force generated by the auxiliary propulsion device are used in combination, and configured or programmed to restrict the main propulsion device and the auxiliary propulsion device from being driven according to the combined use mode when the propeller of the auxiliary propulsion device is in the above-water position; wherein the controller is configured or programmed to determine whether or not the propeller of the auxiliary propulsion device is in the above-water position in the combined use mode, and to restrict the main propulsion device and the auxiliary propulsion device from being driven if the propeller of the auxiliary propulsion device is in the above-water position.

2. The watercraft propulsion system according to claim 1, wherein the controller is configured or programmed to determine whether or not the propeller of the auxiliary propulsion device is in the above-water position, and to restrict a control mode from being switched to the combined use mode if the propeller of the auxiliary propulsion device is in the above-water position.

3. The watercraft propulsion system according to claim 1, further comprising:

a command input operable by an operator to command to switch a control mode to the combined use mode; wherein the controller is configured or programmed to actuate the lift to locate the propeller of the auxiliary propulsion device in the underwater position if the combined use mode is commanded by the command input.

4. The watercraft propulsion system according to claim 1, wherein the combined use mode includes a holding mode in which at least one of a position and an azimuth of the hull is maintained.

5. The watercraft propulsion system according to claim 1, wherein the main propulsion device is an engine propulsion device including an engine as its power source; and the auxiliary propulsion device is an electric propulsion device including an electric motor as its power source.

6. The watercraft propulsion system according to claim 1, wherein the main propulsion device and the auxiliary propulsion device are attached to a stern of the hull.

7. The watercraft propulsion system according to claim 1, wherein the controller is configured or programmed to prohibit the main propulsion device and the auxiliary propulsion device from being driven in the combined use mode when the propeller of the auxiliary propulsion device is in the above-water position.

8. A watercraft propulsion system comprising:

a main propulsion device attachable to a hull;

an auxiliary propulsion device attachable to the hull and having a lower rated output than the main propulsion device;

a lift to move up and down a propeller of the auxiliary propulsion device between an underwater position and an above-water position; and a controller including a plurality of control modes including a combined use mode in which a propulsive force generated by the main propulsion device and a propulsive force generated by the auxiliary propulsion device are used in combination, and configured or programmed to restrict the main propulsion device and the auxiliary propulsion device from being driven according to the combined use mode when the propeller of the auxiliary propulsion device is in the above-water position; wherein the controller is configured or programmed to limit maximum outputs of the main propulsion device and the auxiliary propulsion device in the combined use mode when the propeller of the auxiliary propulsion device is in the above-water position.

9. A watercraft comprising:

a hull; and the watercraft propulsion system according to claim 1 provided on the hull.

10. A watercraft comprising:

a hull; and the watercraft propulsion system according to claim 8 provided on the hull.

* * * * *